US012767416B2

(12) United States Patent
Ebrahim et al.

(10) Patent No.: US 12,767,416 B2
(45) **Date of Patent: *Oct. 20, 2026**

(54) CONTAINER FOR FOOD PRESERVATION AND PRESENTATION

(71) Applicant: LUCID CORP., Brampton (CA)

(72) Inventors: Salman Ebrahim, Brampton (CA); Edmund Shee Tong Chin, Brampton (CA); Sajith Chenat, Brampton (CA); Jaskaran Singh Sukhija, Brampton (CA); Tajinder Singh, Brampton (CA)

(73) Assignee: LUCID CORP., Brampton (CA)

( * ) Notice: Subject to any disclaimer, the term of this patent is extended or adjusted under 35 U.S.C. 154(b) by 99 days.

This patent is subject to a terminal disclaimer.

(21) Appl. No.: 18/943,534

(22) Filed: Nov. 11, 2024

(65) Prior Publication Data

US 2025/0066102 A1 Feb. 27, 2025

Related U.S. Application Data

(63) Continuation of application No. 18/610,252, filed on Mar. 19, 2024, now Pat. No. 12,179,988, which is a (Continued)

(51) Int. Cl.
*B65D 81/26* (2006.01)
*B65D 75/52* (2006.01)

(52) U.S. Cl.
CPC ..... *B65D 81/262* (2013.01); *B65D 75/522* (2013.01); *B65D 75/525* (2013.01)

(58) Field of Classification Search
CPC .. B65D 81/262; B65D 25/107; B65D 81/264; B65D 75/525
(Continued)

(56) References Cited

U.S. PATENT DOCUMENTS 3,155,303 A 11/1964 Fenkel
3,155,307 A 11/1964 Pinkas
(Continued)

FOREIGN PATENT DOCUMENTS

CH 663943 A5 1/1988
DE 3406399 A1 8/1985
(Continued)

*Primary Examiner* — Anthony D Stashick
*Assistant Examiner* — Raven Collins
(74) *Attorney, Agent, or Firm* — SMART & BIGGAR LP; James Raakman; Justin Philpott

(57) ABSTRACT

A container for food items includes a base and an insert. The base includes a bottom panel and a peripheral bead having an inner sidewall extending upward from a perimeter of the bottom panel and a top wall extending outward from the inner sidewall. The inner sidewall and the bottom panel enclose, laterally and from below, a liquid collection reservoir. A base peripheral engagement surface includes the top wall and extends about the collection reservoir. The insert includes a support panel having drain apertures therein, an insert sidewall extending upward from a periphery of the support panel, and a flange extending outward from an upper end of the insert sidewall. An insert peripheral engagement surface includes at least a portion of the flange and is releasably interlockable with the base peripheral engagement surface when the insert is assembled to the base with the support panel overlying the collection reservoir.

19 Claims, 19 Drawing Sheets

Related U.S. Application Data continuation of application No. PCT/CA2023/051326, filed on Oct. 6, 2023.

(60) Provisional application No. 63/414,271, filed on Oct. 7, 2022.

(58) Field of Classification Search
USPC ..... 220/501
See application file for complete search history.

(56) References Cited

U.S. PATENT DOCUMENTS

| | | | |
|---|---|---|---|
| 5,655,708 | A | 8/1997 | Groene |
| 5,705,213 | A | 1/1998 | Guillin |
| 7,395,923 | B2 | 7/2008 | Chou |
| 7,921,992 | B2 | 4/2011 | Larue et al. |
| 8,474,610 | B1 | 7/2013 | Knight |
| 10,414,571 | B2 | 9/2019 | Wallace |
| 2009/0114552 | A1 | 5/2009 | Hall et al. |
| 2010/0212827 | A1 | 8/2010 | Larue et al. |
| 2021/0229890 | A1 | 7/2021 | Guirguis |
| 2022/0258948 | A1 | 8/2022 | Morrow et al. |
| 2023/0202735 | A1 | 6/2023 | Wallace |

FOREIGN PATENT DOCUMENTS

| | | | |
|---|---|---|---|
| EP | 0495230 | B1 | 7/1992 |
| EP | 3875399 | A1 | 9/2021 |
| FR | 2564807 | A1 | 11/1985 |
| JP | 2006151400 | A | 6/2006 |
| WO | 8607036 | A1 | 12/1986 |
| WO | 9306026 | A2 | 4/1993 |
| WO | 2007122276 | A1 | 11/2007 |
| WO | 2017027918 | A1 | 2/2017 |
| WO | 2021177824 | A1 | 9/2021 |
| WO | 2022199099 | A | 9/2022 |

CONTAINER FOR FOOD PRESERVATION AND PRESENTATION

CROSS-REFERENCE TO RELATED APPLICATION

This application is a continuation of U.S. patent application Ser. No. 16/610,252, filed Mar. 19, 2024, which is a continuation of International Application No. PCT/CA2023/051326, filed Oct. 6, 2023, which claims the benefit of U.S. Provisional Patent Application No. 63/414,271 filed Oct. 7, 2022, the entirety of each of which is incorporated herein by reference.

FIELD

The teaching disclosed herein relates to containers for food items, and in particular to containers that include a reservoir to collect liquid exuded by the food item(s) held therein.

INTRODUCTION

U.S. Pat. No. 5,705,213 (Guillin) discloses a package for the packaging and the preservation of fresh food, such as meat, sea products and the like. The package is of the type which includes a tray upon which the fresh food product is placed, and a thermoretractable thin sheet of film material for overlapping the food product contained in the tray. The tray includes a relatively rigid and impermeable first container portion and a second container portion upon which the fresh food product rests. The second container portion is fitted in the first container portion, and includes apertures which allows for the passage of fluid which may be exuded by the fresh food product. The second container portion rests on corrugations or ribs of the first container portion to define a desired number of closed chambers, characterized that in order to allow an isostatic rigidification of the first container portion, and a controlled collecting of the fluids exuded by the fresh food product into the chambers, the ribs are distributed according to at least one network of approximately parallel ribs. Each of the ribs extends at least along two directions so that each of the points of the rib is directed to resist a corresponding component of the peripheral stresses caused by the film material which overwraps the package.

U.S. Pat. No. 7,921,992 (LaRue et al.) discloses a container that includes a first tray, and a second tray disposed within the space of the first tray to define a reservoir therebetween. The first tray has a first bottom wall and a surrounding first sidewall, which extends generally upwardly from the first bottom wall to define a space therein. The second tray has a second bottom wall and a surrounding second sidewall, which also extends generally upwardly from the second bottom wall. The second bottom wall has at least one aperture defined in a central region thereof, and also has an upper surface, which slopes downwardly toward the at least one aperture. The reservoir defined between the first and second trays is in fluid communication with the aperture.

U.S. Pat. No. 10,414,571 (Wallace) relates to containers and other shaped articles (e.g., trays and dishes) for containing articles such as food products (e.g., cuts of meat and poultry) or liquid-sensitive electronic parts. In one aspect, the container has a reservoir portion into which liquid can be sequestered. In another aspect, the container includes a thermoformable substrate, a liner, and a lidding material, the lidding and the liner defining a compartment for containing articles. The compartment can be detached from the substrate by detaching the liner from the substrate without necessarily rupturing the compartment. A substantial portion of the containers described can be recycled by separating the liner and/or lidding from the substrate. The disclosure also relates to methods of making thermoformed articles having multiple layers that do not rely on use of a coextruded or other composite thermoplastic-containing substrate.

SUMMARY

The following summary is intended to introduce the reader to various aspects of the applicant's teaching, but not to define any invention.

In one aspect, a container for food items is disclosed. The container includes a base and an insert. The base is formed of plastic and includes a reservoir bottom panel and a peripheral bead. The peripheral bead has a bead inner sidewall extending about and upward from a perimeter of the reservoir bottom panel, a bead top wall extending laterally outward from an upper end of the bead inner sidewall, and a bead outer sidewall extending downward from a laterally outer edge of the bead top wall. At least a lower portion of the bead inner sidewall and the reservoir bottom panel enclosing, laterally and from below, a liquid collection reservoir. The base further includes a base lower peripheral engagement surface extending about the liquid collection reservoir. The base lower peripheral engagement surface comprises at least a portion of the bead top wall. The insert is formed of plastic and includes a support panel, an insert lower sidewall extending upward from a periphery of the support panel, and an insert lower flange extending laterally outward from an upper end of the insert lower sidewall. The insert has an insert lower peripheral engagement surface comprising at least a portion of the insert lower flange. The insert lower peripheral engagement surface is releasably interlockable with the base lower peripheral engagement surface to assemble the insert to the base with the insert lower flange bearing against the bead top wall and the support panel overlying the liquid collection reservoir. The support panel has a plurality of drain apertures for draining liquid from above into the liquid collection reservoir.

In some examples, at least one of the insert lower peripheral engagement surface and the base lower peripheral engagement surface is resiliently deformable to provide snap-fit, interlocking sealed engagement therebetween when the insert is assembled to the base.

In some examples, the base includes a plurality of spaced apart panel braces, each of the panel braces projecting upwardly from the reservoir bottom panel and abutting an underside surface of the support panel when the insert is assembled to the base to maintain a vertical separation between the support panel and the reservoir bottom panel when in use.

In some examples, the base includes a base sidewall having a base sidewall first end joined to a lower end of the bead outer sidewall, and a base sidewall second end spaced vertically above the base sidewall first end.

In some examples, the base sidewall first end is joined to the lower end of the bead outer sidewall via a base bottom wall extending laterally between the peripheral bead and the and base sidewall.

In some examples, the base sidewall includes a sidewall lower portion disposed at an equal elevation with, and spaced laterally outward from, the lower portion of the bead inner sidewall.

In some examples, the base sidewall second end includes a base rim, and the base rim is rounded to facilitate tear-free engagement with a film wrapped over the container to preserve freshness of the food items.

In some examples, the insert includes an insert upper sidewall having an insert upper sidewall first end joined to an outer edge of the insert lower flange and an insert upper sidewall second end spaced above the insert upper sidewall first end.

In some examples, the base sidewall includes a sidewall upper portion disposed at an elevation greater than the bead top wall and having a sidewall inner surface, and the insert upper sidewall has a sidewall outer surface that bears in flush engagement with the sidewall inner surface of the base when the insert is assembled to the base.

In another aspect, a container for food items is disclosed. The container includes a base and an insert. The base is formed of plastic and includes a reservoir bottom panel, and a reservoir sidewall. The reservoir sidewall extends about and upward from a perimeter of the reservoir bottom panel. The reservoir sidewall includes a lower portion and an upper portion disposed laterally outward of the lower portion and connected to the lower portion by a generally horizontal step surface. At least the lower portion of the reservoir sidewall and the reservoir bottom panel enclosing, laterally and from below, a liquid collection reservoir. The base further includes a base lower peripheral engagement surface extending about the liquid collection reservoir. The base lower peripheral engagement surface comprises at least a portion of the reservoir sidewall. The insert is formed of plastic and includes a support panel, an insert lower sidewall extending upward from a periphery of the support panel, and an insert lower flange extending laterally outward from an upper end of the insert lower sidewall. The insert further includes an insert lower peripheral engagement surface comprising at least a portion of the insert lower sidewall. The insert lower peripheral engagement surface is releasably interlockable with the base lower peripheral engagement surface to assemble the insert to the base with the support panel overlying the liquid collection reservoir. The support panel has a plurality of drain apertures for draining liquid from above into the liquid collection reservoir. When the insert is assembled to the base, an outer surface of the insert lower sidewall bears against an inner surface of the reservoir upper sidewall and an underside surface of the periphery of the support panel beneath the insert lower sidewall bears against the step surface of the reservoir sidewall.

In some examples, the base further comprises a bead top wall extending laterally outward from an upper end of the reservoir sidewall, and a bead outer sidewall extending downward from a laterally outer edge of the bead top wall. The reservoir sidewall, the bead top wall, and the bead outer sidewall form a peripheral bead extending about the liquid collection reservoir.

In some examples, at least one of the insert lower peripheral engagement surface and the base lower peripheral engagement surface is resiliently deformable to provide snap-fit, interlocking sealed engagement therebetween when the insert is assembled to the base.

In some examples, the base includes a plurality of spaced apart panel braces, each of the panel braces projecting upwardly from the reservoir bottom panel and abutting an underside surface of the support panel when the insert is assembled to the base to maintain a vertical separation between the support panel and the reservoir bottom panel when in use.

In some examples, the base includes a base sidewall having a base sidewall first end joined to a lower end of the bead outer sidewall, and a base sidewall second end spaced vertically above the base sidewall first end.

In some examples, the base sidewall first end is joined to the lower end of the bead outer sidewall via a base bottom wall extending laterally between the peripheral bead and the and base sidewall.

In some examples, the base sidewall includes a sidewall lower portion disposed at an equal elevation with, and spaced laterally outward from, the lower portion of the reservoir inner sidewall.

In some examples, the base sidewall second end includes a base rim, and the base rim is rounded to facilitate tear-free engagement with a film wrapped over the container to preserve freshness of the food items.

In some examples, the insert includes an insert upper sidewall having an insert upper sidewall first end joined to an outer edge of the insert lower flange and an insert upper sidewall second end spaced above the insert upper sidewall first end.

In some examples, the base sidewall includes a sidewall upper portion disposed at an elevation greater than the bead top wall and having a sidewall inner surface, and the insert upper sidewall has a sidewall outer surface that bears in flush engagement with the sidewall inner surface of the base when the insert is assembled to the base.

Other aspects and features of the teachings disclosed herein will become apparent to those ordinarily skilled in the art, upon review of the following description of the specific examples of the present disclosure.

DRAWINGS

For a better understanding of the described examples and to show more clearly how they may be carried into effect, reference will now be made, by way of example, to the accompanying drawings in which.

The drawings included herewith are for illustrating various examples of apparatuses and methods of the teaching of the present specification and are not intended to limit the scope of what is taught in any way.

DETAILED DESCRIPTION

Various apparatuses or processes will be described below to provide an example of each claimed invention. No example described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an example of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Figure 1:
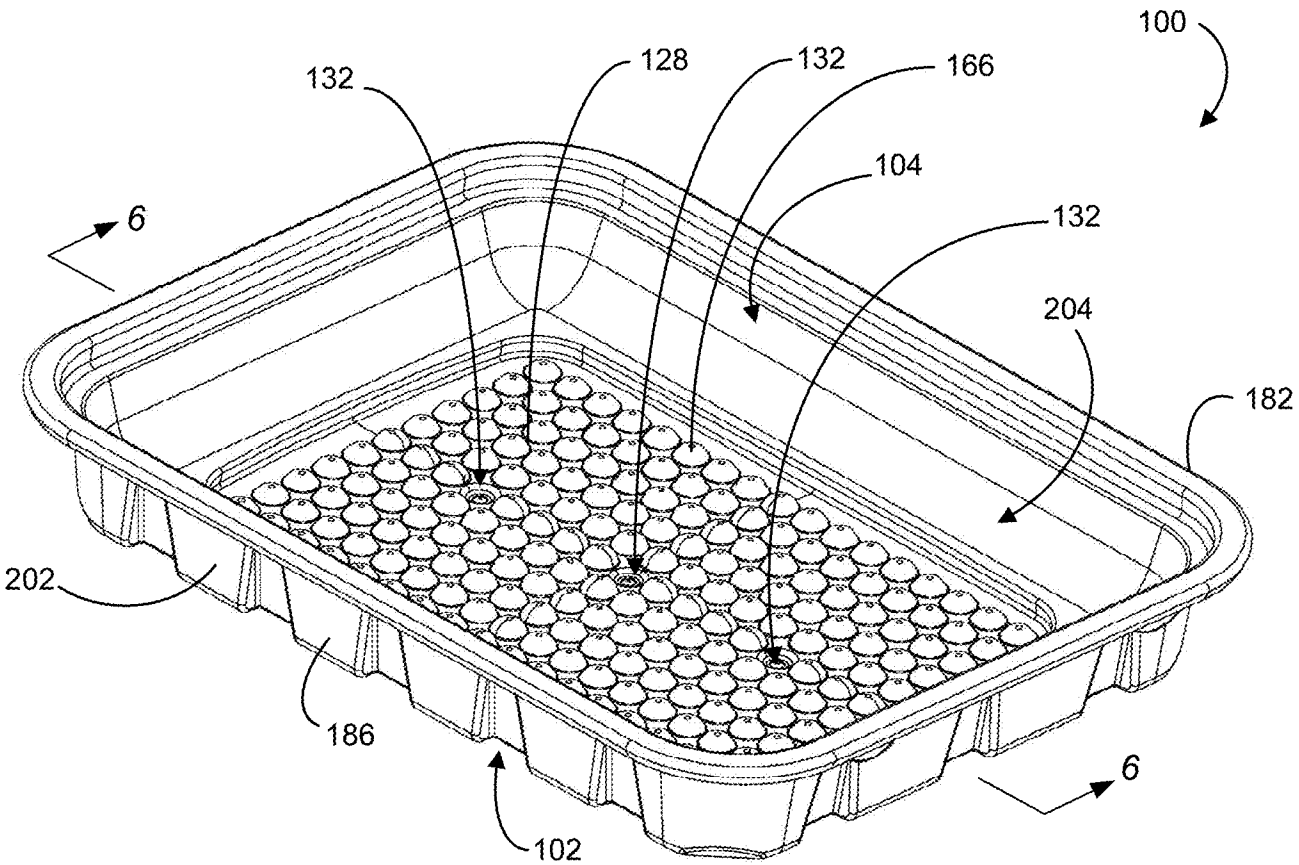
FIG. 1 is a perspective view of an example container for food items according to aspects of the teaching disclosed herein.
Figure 2:
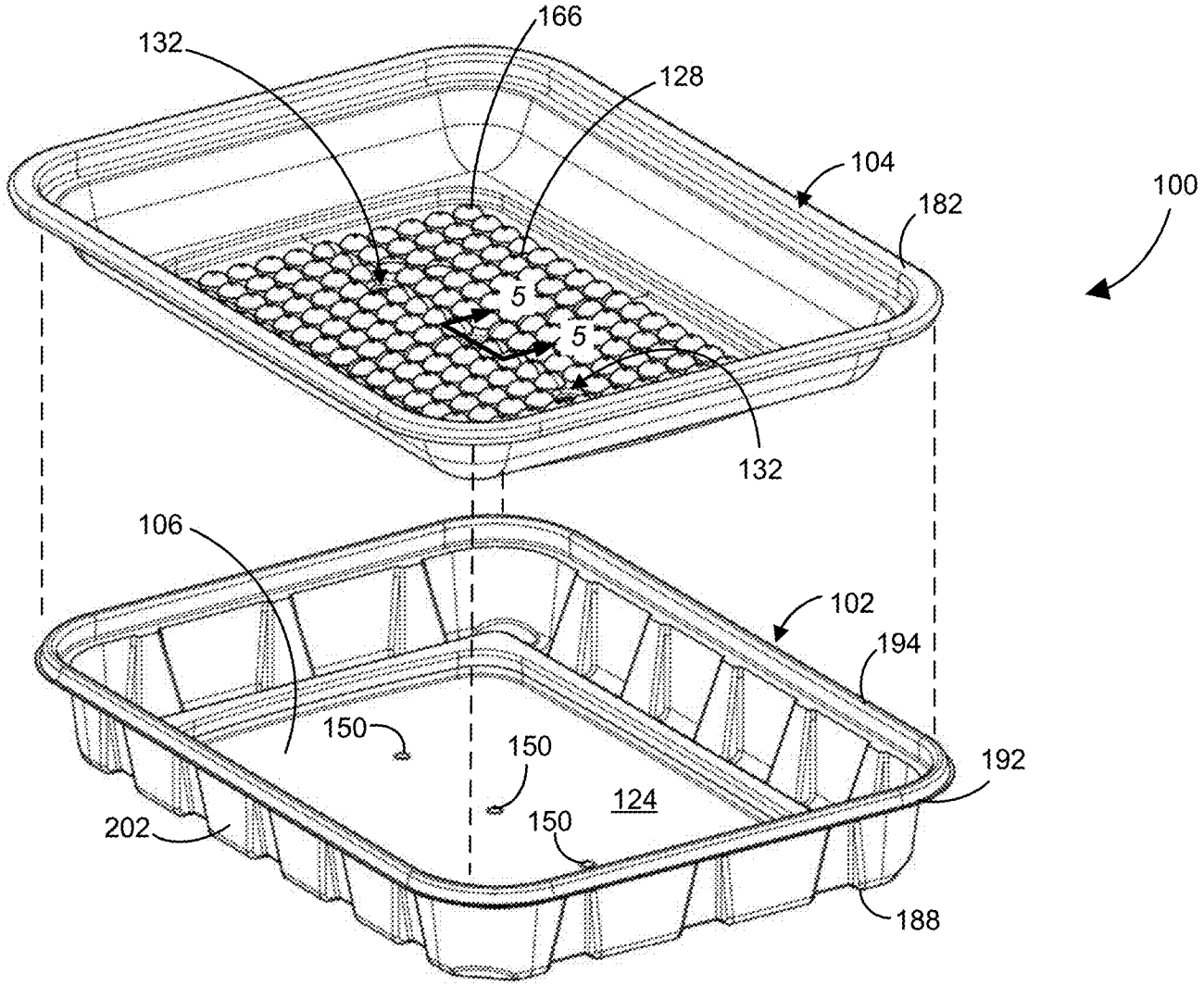
FIG. 2 is an exploded perspective view of the container of FIG. 1.
Figure 3:
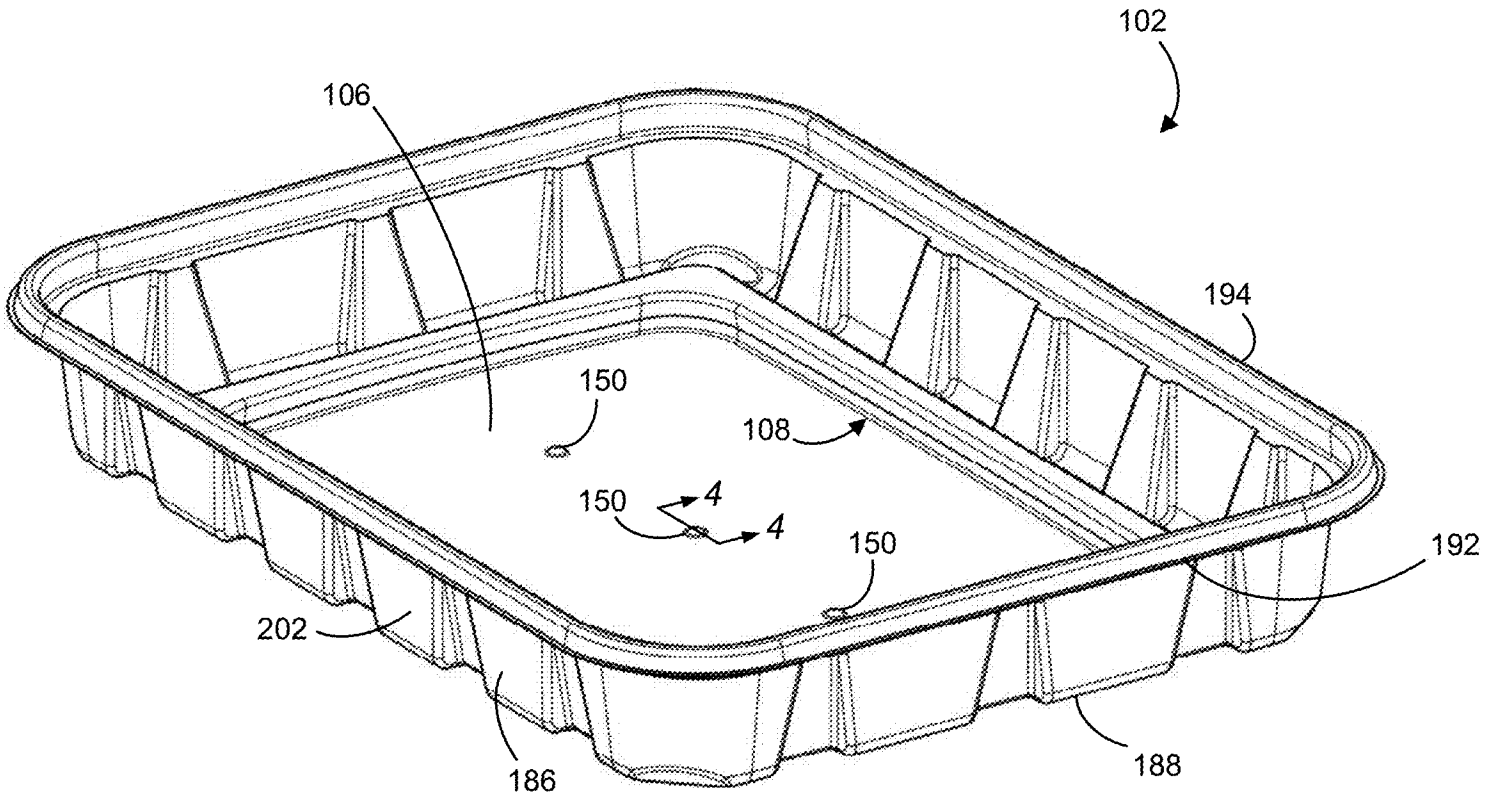
FIG. 3 is a perspective view of a base of the container of FIG. 1.
Figure 4:
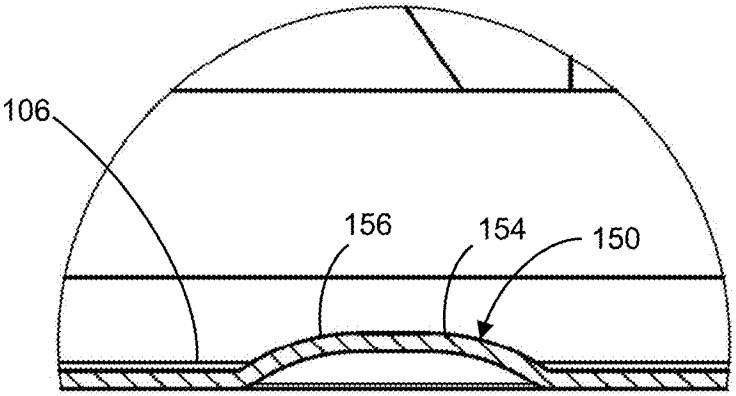
FIG. 4 is a cross-sectional view of a portion of the base of FIG. 3 taken along line 4-4.

Referring to FIGS. 1 and 2, a container 100 for food items in accordance with aspects of the teaching disclosed herein includes liquid management features to help better preserve food held in the container and to help the food in the container look more appealing to a potential purchaser. Some food items, such as fresh meat, fresh fruit, cut fruits or vegetables, etc., are high in moisture content and exude liquid when placed in a container for sale to an end customer. Such liquid can be damaging to the food item, for example, if the food item is in prolonged contact with the liquid. Such liquid can also be unsightly (particularly if the liquid is biological, such as blood) and makes purchasing the food item unattractive to the customer.

As disclosed in more detail subsequently herein, the container 100 mitigates these problems by providing a base 102 and an insert 104 removably attachable to the base 102. When the insert 104 is assembled onto the base 102, the container 100 provides a space above the insert 104 to hold food items, and a space below the insert 104 inside the base 102 to collect liquid exuded from the food items, such that the food items are separated from the liquid and visibility of the liquid is reduced (e.g., when the container is on display for merchandising). Need for a separate pad placed under the food item to absorb liquid is avoided, and after use the insert 104 can be removed from the base 102 to facilitate rinsing any exuded liquid, thereby promoting recyclability of the container 100.

The base 102 includes a reservoir bottom panel 106 for enclosing a liquid collection reservoir 124 (FIG. 6) from below. In the example illustrated, the base 102 further includes a peripheral bead 108 that encircles a perimeter of the reservoir bottom panel 106. The peripheral bead 108 has a bead inner sidewall 110 (FIG. 6, FIG. 8) extending about and upward from a perimeter 112 of the reservoir bottom panel 106, a bead top wall 114 extending laterally outward from an upper end 116 of the bead inner sidewall 110, and a bead outer sidewall 118 extending downward from a laterally outer edge 120 of the bead top wall 114. At least a lower portion 122 of the bead inner sidewall 110 and the reservoir bottom panel 106 enclose, laterally and from below, the liquid collection reservoir 124.

In the example illustrated, the base 102 and insert 104 are formed from plastic sheet material in a thermoforming process. The plastic sheet is, in the example illustrated, of unpigmented, transparent PET material that is readily recyclable. In some examples, portions of the unpigmented material can be treated (e.g., embossed) to have a frosted appearance rendering such portions translucent. In some examples, the base 102 and insert 104 are formed from a translucent or opaque plastic material. The size and shape of the container 100 can be selected to meet the requirements of the food packager. In the example illustrated, the container 100 has a generally rectangular shape.

Referring again to FIGS. 6 and 8, the base 102 includes a base lower peripheral engagement surface 126 extending about the liquid collection reservoir 124. The insert 104 includes a support panel 128 having an insert lower peripheral engagement surface 130. The insert lower peripheral engagement surface 130 is releasably inter-lockable with the base lower peripheral engagement surface 126 to assemble the insert 104 to the base 102 with the support panel 128 overlying the liquid collection reservoir 124.

Figure 8:
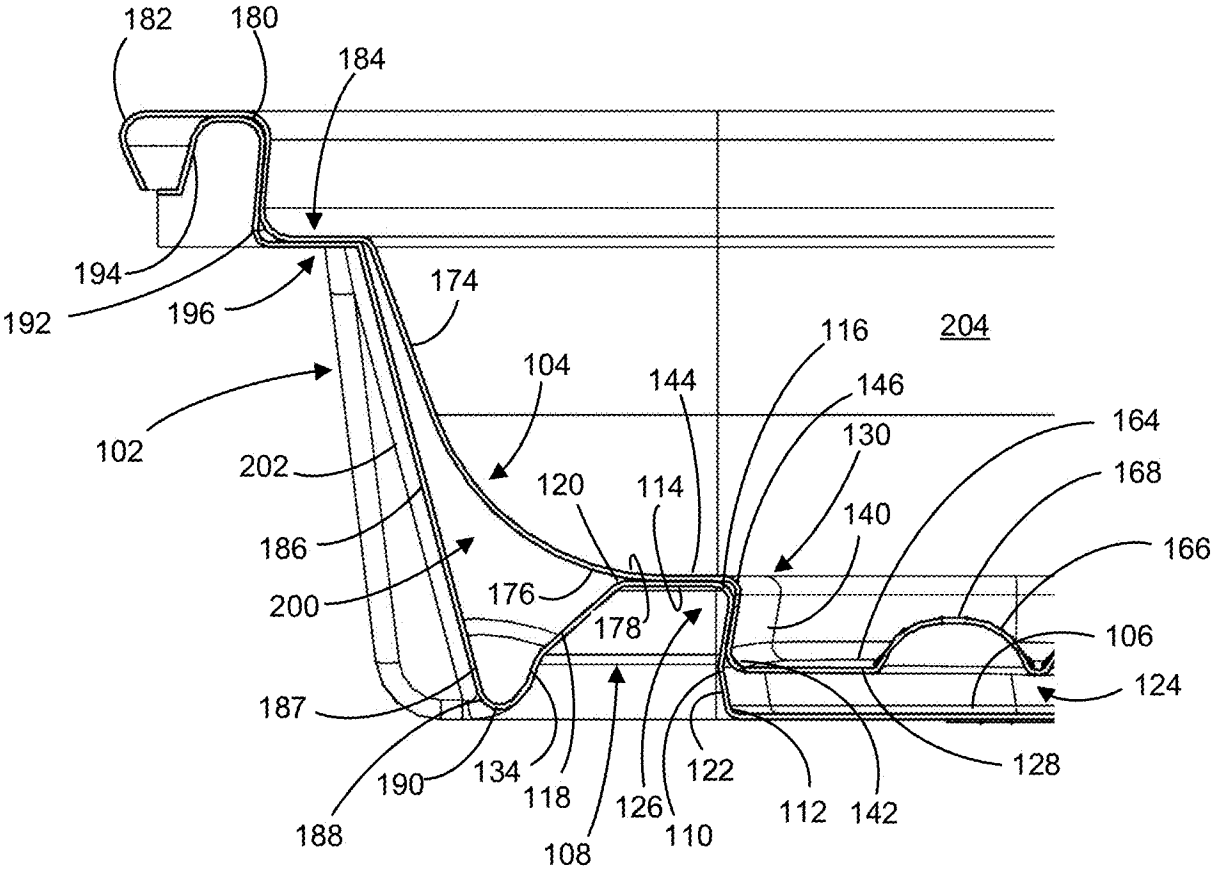
FIG. 8 is an enlarged view of a portion of the container identified at box 8 of FIG. 6.

In some examples, the base lower peripheral engagement surface 126 includes at least a portion of the bead inner sidewall 110. In some examples, the base lower peripheral engagement surface 126 includes at least a portion of the bead top wall 114. In the example illustrated, the base lower peripheral engagement surface 126 includes an upper portion of the bead inner sidewall 110 and a laterally inner portion of the bead top wall 114 (FIG. 8).

In the example container 100, the insert 104 includes an insert lower sidewall 140 (FIG. 8) extending upward from a panel perimeter 142 (see also FIG. 2) of the support panel 128. The insert 104, in the example illustrated, further includes an insert lower flange 144 extending laterally outward from an upper end 146 of the insert lower sidewall 140. The insert lower flange 144 bears against the bead top wall 114 when the example insert 104 and base 102 are assembled together.

In some examples, the insert lower peripheral engagement surface 130 includes at least a portion of the insert lower sidewall 140. In some examples, the insert lower peripheral engagement surface 130 includes at least a portion of the insert lower flange 144. In the example illustrated, the insert lower peripheral engagement surface 130 includes at least an upper portion 148 of the insert lower sidewall 140 and a laterally inner portion 149 of the insert lower flange 144.

In the example illustrated, snap-fit interlocking assembly of the base and insert lower peripheral engagement surfaces 126, 130 is facilitated by having the upper end of the bead inner sidewall 110 define (or bound) an opening that is slightly smaller than a footprint defined by the lower edge of the insert lower sidewall 140. To assemble the insert 104 onto the base 102, the lower edge of the insert lower sidewall 140 can be pressed vertically downward (as viewed in FIG. 8) against the base 102 and urged past the upper end of the bead inner sidewall 110, resiliently deforming the respective surfaces of the insert and base, until the surfaces pass one another and the bead inner sidewall 110 and the insert lower sidewall 140 snap back toward their undeformed state. Some resilient compressive forces remain upon assembly, so that a generally fluid-tight seal is provided by the interlocking engagement of the lower peripheral engagement surfaces 126, 130.

In the example illustrated, at least a portion 134 of the bead outer sidewall 118 is at equal elevation with, and spaced laterally outward from, the lower portion 122 of the bead inner sidewall 110 (FIG. 8). Spacing the bead outer sidewall 118 laterally outwardly from the bead inner sidewall 110 provides a gap that spaces the liquid collection reservoir 124 further laterally inward than would be the case without such gap. The gap can provide a thermal break between the bead outer sidewall 118 and the liquid collection reservoir 124, which can, for example, help protect a user's hand from hot or cold temperatures associated with handling the container when filled with hot or cold contents. The bead outer sidewall 118 positioned laterally outward of the bead inner sidewall 110 additionally or alternatively can help to conceal liquid in the liquid collection reservoir 124 by impeding visual access to such liquid.

Referring again to FIG. 8, in the example illustrated, the bead inner sidewall 110 extends vertically upward from the reservoir bottom panel to the bead top wall 114, and the lower portion 122 of the bead inner sidewall 110 spans an elevation extending upward from the reservoir bottom panel 106 to the lower end of the insert lower sidewall 140. The bead outer sidewall 118 extends at an incline (at about 45 degrees, in the example illustrated) downward and laterally outward from the bead top wall 114 to an elevation generally equal to that of the reservoir bottom panel 106. The lower portion 134 of the bead outer sidewall 118 spans the same elevation as the lower portion 122 of the bead inner sidewall 110, namely, the elevation extending upward from the reservoir bottom panel 106 to the lower end of the insert lower sidewall 140. In the example illustrated, the base 102 is formed of transparent plastic, and a single transparent sidewall such as the bead inner sidewall 110 does little to prevent visual access of liquid bearing thereagainst. The bead outer sidewall 118, as described in the example illustrated, positions the reservoir inwardly of an outer periphery of the container 100 and provides a second wall in a line of sight that, as taught by the inventors, can significantly impede visual access to liquid in the liquid collection reservoir 124. In the example illustrated, the base 102 includes an optional base sidewall 186 (described in more detail subsequently herein) that further impedes visual access to liquid in the liquid collection reservoir 124.

Referring again to FIG. 1, the support panel 128 has at least one drain aperture 132 for draining liquid from above into the liquid collection reservoir 124. In the example illustrated, the support panel 128 has three drain apertures 132. The three drain apertures 132 are, in the example illustrated, spaced apart along a longitudinal centerline of the support panel 128. The number of drain apertures 132 included in the support panel 128 may vary depending upon the size of the container 100. For example, a larger container 100 may include more drain apertures 132 than a smaller container 100.

Figure 6:
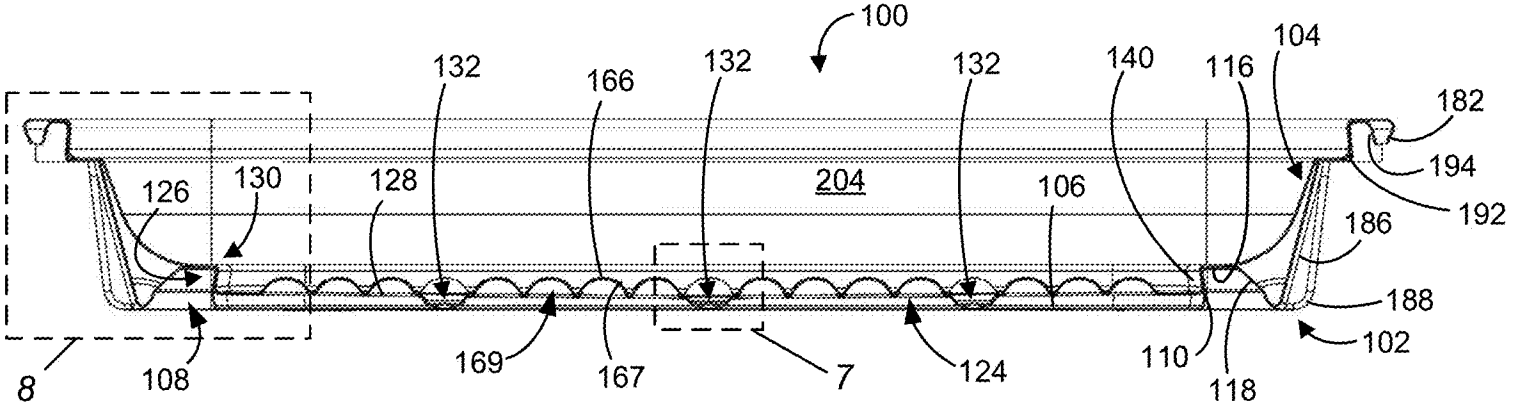
FIG. 6 is a cross-sectional view of the container of FIG. 1 taken along line 6-6.
Figure 7:
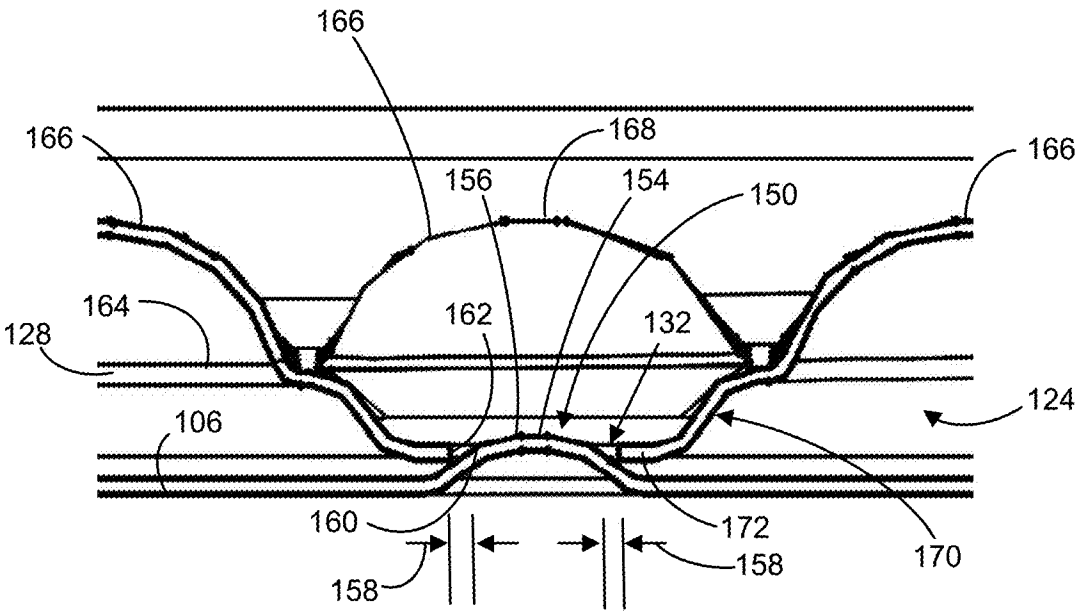
FIG. 7 is an enlarged view of a portion of the container identified at box 7 of FIG. 6.

In some examples, the support panel 128 may be contoured to promote liquid flow along the panel upper surface 164 to one or more of the drain apertures 132. In the example illustrated, an elevation of the support panel 128 proximate the insert lower sidewall 140 is higher than an elevation of the support panel 128 at the drain apertures 132 (FIG. 6). Such a configuration facilitates the flow of exuded liquid along the panel upper surface 164 to the drain apertures 132 (FIG. 7). In cases where the container 100 is inverted, such a configuration may also impede the collected liquid from flowing along a lower surface of the support panel 128 to the one or more drain apertures 132 (i.e., because the lower panel surface slopes away from the drain apertures 132 when the container 100 is inverted).

The base 102, in the example illustrated, includes a flow regulator 150 for each drain aperture 132 of the insert 104 (FIG. 2). With reference to FIG. 7, the flow regulator 150 projects upward from the reservoir bottom panel 106 and is aligned with the drain aperture 132 when the insert 104 is assembled to the base 102. The flow regulator 150 occludes a central portion of the drain aperture 132 to regulate liquid flow through the drain aperture 132 and to further help inhibit reverse flow of liquid from the liquid collection reservoir 124 back through the drain aperture 132 when the container 100 is tilted or inverted.

In the example illustrated, an upper portion 154 of the flow regulator 150 protrudes through the drain aperture 132 (FIG. 7). In the example illustrated, the drain aperture 132 is circular and the flow regulator 150 includes a rounded upwardly projecting bulge 156 concentric with the drain aperture 132. An annular flow gap 158 is, in the example illustrated, provided between an outer surface 160 of the flow regulator 150 and an inner surface 162 of the drain aperture 132.

Figure 5:
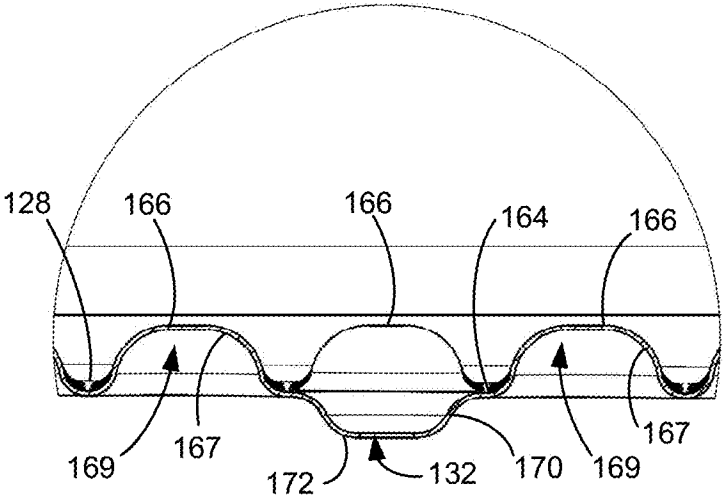
FIG. 5 is a cross-sectional view of a portion of the container of FIG. 2 taken along line 5-5.

In the example illustrated, the support panel 128 includes a panel upper surface 164 and a plurality of spaced-apart risers 166 projecting upward from the panel upper surface 164 (FIGS. 2 and 5). The risers 166 each have a riser top surface 168 (FIG. 5) spaced above the panel upper surface 164 for holding food items in the container 100 above the panel upper surface 164 and facilitating flow of liquid from the food items along the panel upper surface 164 between the risers 166 and to the drain apertures 132. In the example illustrated, the panel upper surface 164 between the risers 166 is generally flat and inclined toward the drain apertures 132. The top surface 168 of each riser 166 is, in the example illustrated, rounded to facilitate drainage from the food item to the panel upper surface 164.

In the example illustrated, the risers 166 have hollow interiors 169 bounded at least in part by concave inner surfaces 167 (FIG. 5). The inner surfaces 167 of the risers are directed toward the reservoir bottom panel 106 and form a ceiling of the liquid collection reservoir 124 (FIG. 6). In cases where the container 100 may be inverted or near-inverted, such as, for example, during handling by a potential purchaser, liquid can collect in the riser interiors 169 which can help prevent liquid from flowing in reverse through the drain apertures 132, from the (inverted) liquid collection reservoir 124 back toward the food item in the container 100.

In the example illustrated, the support panel 128 includes a depression 170 associated with each drain aperture 132 (FIGS. 5 and 7). In the example illustrated, each depression 170 has a lowered central wall 172 with an upward facing surface that is lower than the panel upper surface 164 adjacent the depression 170 (FIG. 7). The drain aperture 132, in the example illustrated, extends through the lowered central wall 172 of the depression 170. This configuration increases a vertical spacing between the drain aperture 132 and the panel upper surface 164 of the support panel 128 of the insert 104. The depressions 170 can facilitate the draining process. For example, in cases where a volume of liquid is exuded at a rate faster than the rate through which the liquid can pass through the drain aperture 132, the depressions 170 can serve as overflow basins. Furthermore, the depressions 170 can help prevent backflow of liquid through the drain aperture 132 from the liquid collection reservoir 124 toward the food item. For example, in cases where the container 100 may be inverted, the elevation of the drain aperture 132 is spaced above the panel upper surface 164 (and further above the riser inner surfaces 167), making it less likely that the liquid would pass back through the drain apertures 132.

Referring again to FIGS. 6 and 8, in the example illustrated, the insert 104 includes an insert upper sidewall 174 having an insert upper sidewall first end 176 joined to an outer edge 178 of the flange 144 and an insert upper sidewall second end 180 spaced vertically above the insert upper sidewall first end 176 (FIG. 8). The insert upper sidewall 174, in the example illustrated, includes an insert rim 182 formed at the insert upper sidewall second end 180. The insert rim 182 may be rounded to facilitate tear-free engagement with a film wrapped over the container 100 to preserve freshness of the food items.

With reference to FIGS. 6 and 8, the insert upper sidewall second end 180 includes an insert upper peripheral engagement surface 184 extending about the container 100. In the example illustrated, the insert upper peripheral engagement surface 184 extends about the container 100 along the insert upper sidewall second end 180.

In the example illustrated, the base 102 includes a base sidewall 186 having a base sidewall first end 188 joined to a lower end 190 of the bead outer sidewall 118, and a base sidewall second end 192 spaced vertically above the base sidewall first end 188 (FIG. 8).

The base sidewall second end 192 includes a base rim 194. The base rim 194 may be rounded or otherwise cooperate with the rounded insert rim 182 to facilitate tear-free engagement with film wrapped over the container 100.

With reference to FIGS. 6 and 8, the base sidewall second end 192 includes a base upper peripheral engagement surface 196 extending about the container 100. In the example illustrated, the base upper peripheral engagement surface 196 extends about the container 100 along the base sidewall second end 192.

In the example illustrated, a portion of the base sidewall 186 between the base sidewall first end 188 and the base sidewall second end 192 is disposed laterally outwardly of the bead outer sidewall 118 when the insert 104 is assembled to the base 102 (FIG. 8). In the example illustrated, a lower portion 187 of the base sidewall 186 is at equal elevation with, and spaced laterally outward from, the lower portion 122 of the bead inner sidewall 110, which further impedes visual access to liquid in the liquid collection reservoir 124. In some examples, the lower portion 187 of the base sidewall 186 is translucent or opaque to further impede visual access to liquid in the liquid collection reservoir 124.

The insert upper peripheral engagement surface 184 is releasably inter-lockable with the base upper peripheral engagement surface 196 when the insert 104 is assembled to the base 102. In the example illustrated, a sealed chamber 200 extends between the interlocked upper peripheral engagement surfaces 184, 196 and the interlocked lower peripheral engagement surfaces 126, 130, and about the container 100. The sealed chamber 200 provides a thermal break between an outer surface 202 of the base sidewall 186 and an interior 204 of the container 100 (FIG. 8). This can help insulate heated or cooled food items in the container from the environment so that the food items hold their desired temperature for a longer period of time. The sealed chamber 200 can also help prevent liquid from leaking out of the container 100, for example, in instances where the container is inverted or turned on its side. More particularly, in some instances, the interlocked engagement between the base and insert upper peripherical engagement surfaces 196, 184 and the interlocked engagement between the base and insert lower peripheral engagement surfaces 126, 130 contribute to preventing liquid from leaking out of the container 100.

In use, the insert 104 is assembled onto the base 102 by pressing the insert lower peripheral engagement surface 130 into snap-fit, interlocking sealed engagement with the base lower peripheral engagement surface 126. At the same time, the insert upper peripheral engagement surface 184 can be pressed into snap-fit, interlocking sealed engagement with the base upper peripheral engagement surface 196. Upon assembly of the insert 104 onto the base 102, a food item can be loaded onto the support panel 128 of the insert 104, and plastic wrap or a lid can be installed to cover the top of the container 100. Liquid exuded from the food item can drain into the liquid collection reservoir 124, where it is isolated from the food item, and obscured from view by at least the bead outer sidewalls 118 of the peripheral bead 108.

After use, the base 102 and the insert 104 can be separated to facilitate cleaning and recycling. For example, the base 102 and the insert 104 may be separated to dispose of any liquid collected in the liquid collection reservoir 124. The rinsed and separated base 102 and insert 104 can then be introduced into a recycling process.

Figure 9:
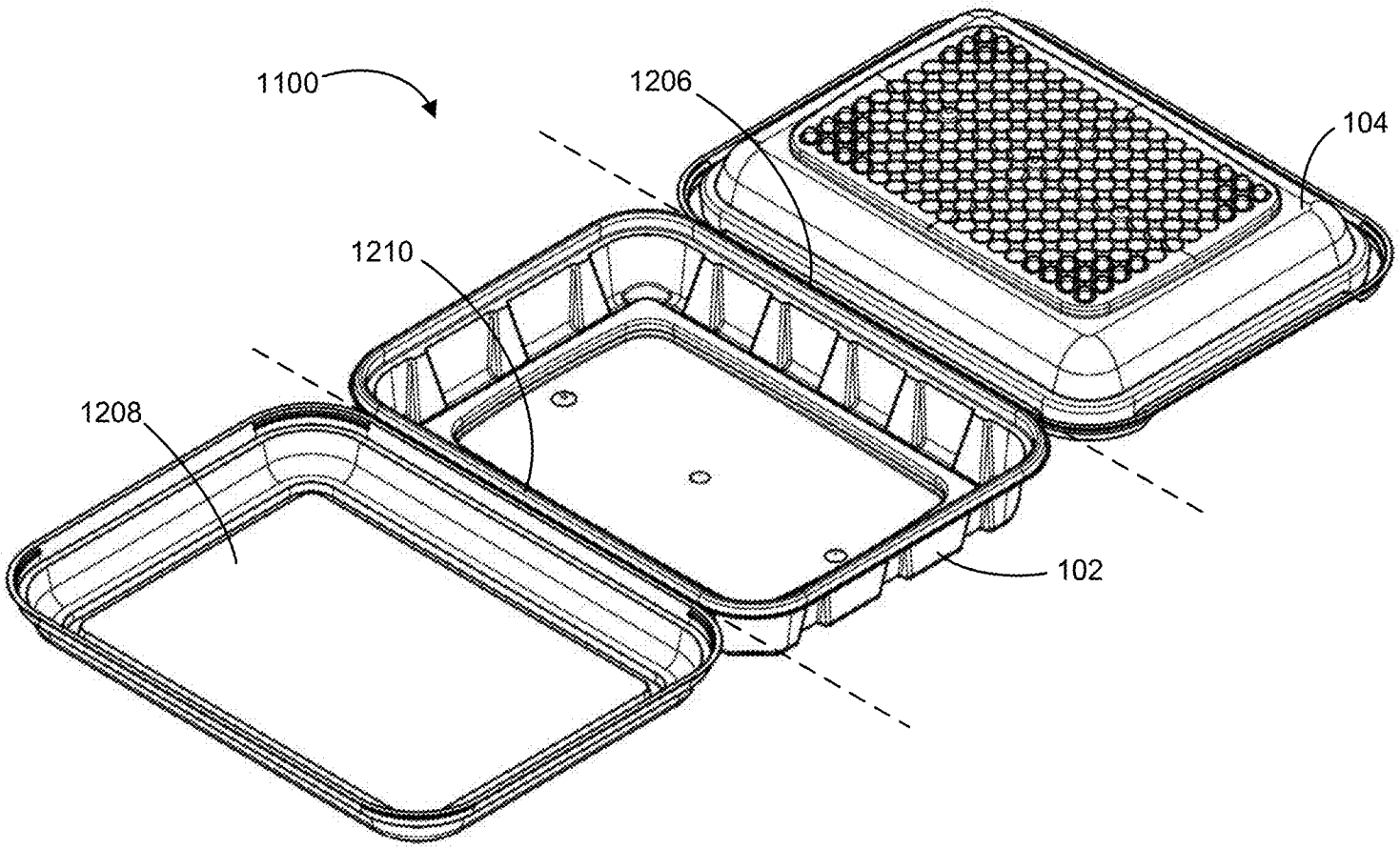
FIG. 9 is a perspective view of another container for food items according to aspects of the teaching disclosed herein.

Referring now to FIG. 9, another example container 1100 in accordance with aspects of the teaching disclosed herein includes the base 102 and the insert 104 of the container 100, but the base 102 and insert 104 are formed together from a single sheet of plastic, and are connected together along a first living hinge 1206. The first living hinge 1206 is formed between respective first upper edges of the base 102 and the insert 104. Assembly of the insert 104 onto the base 102 of the container 1100 includes pivoting the insert 104 relative to the base 102 about the first living hinge 1206.

In the example illustrated, the container 1100 further includes an optional lid 1208 that is releasably engageable with at least one of the insert rim 182 and the base rim 194 to open and close the container. The lid 1208 is, in the example illustrated, formed together with the base 102 and insert 104 from the same single sheet of plastic. The lid 1208 is connected to the base 102 along a second edge of the base by a second living hinge 1210. The container 1100 can be selectively opened and closed by pivoting the lid 1208 relative to the base 102 about the second living hinge 1210.

Referring to FIGS. 10-12A, another example of a container 2100 according to aspects of the present teaching has some similarity to the container 100, with like features identified by like reference characters, incremented by 2000.

Figure 11:
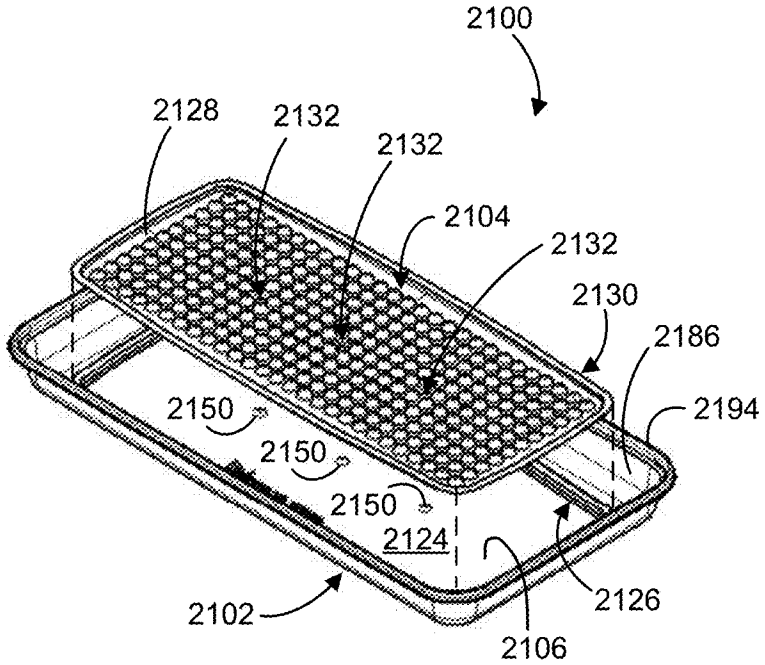
FIG. 11 is an exploded perspective view of the container of FIG. 10.
Figure 10:
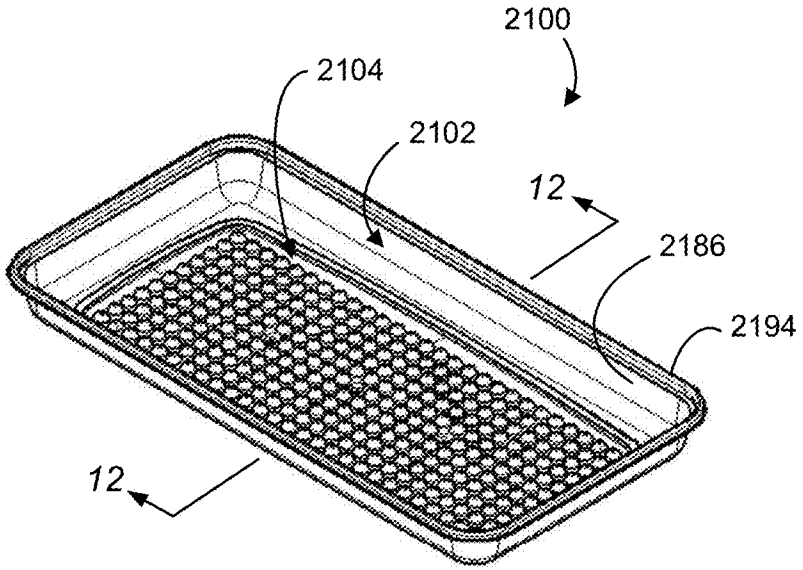
FIG. 10 is a perspective view of another example container for food items according to aspects of the teaching disclosed herein.

Referring to FIG. 11, the container 2100 includes a base 2102 and an insert 2104. In the example illustrated, the base 2102 includes a reservoir bottom panel 2106 and a base lower peripheral engagement surface 2126, like those of the base 102 of the container 100.

Figure 12:
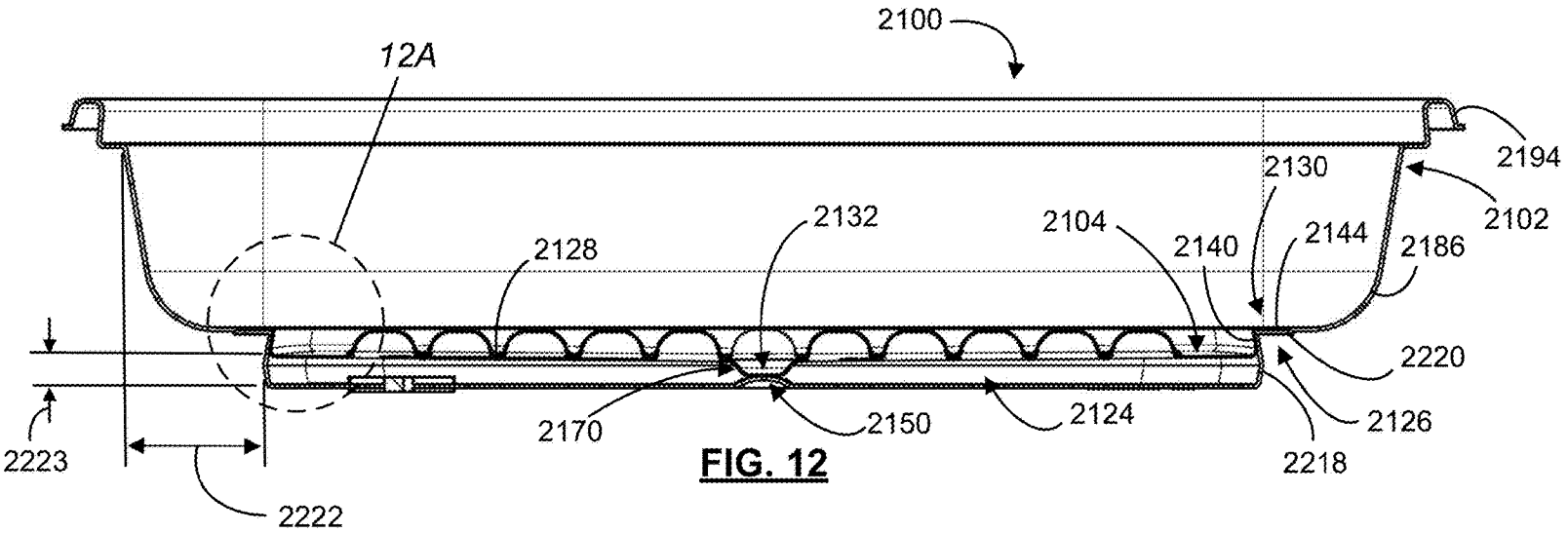
FIG. 12 is a cross-sectional view of the container of FIG. 10 taken along line 12-12.
Figure 12A:
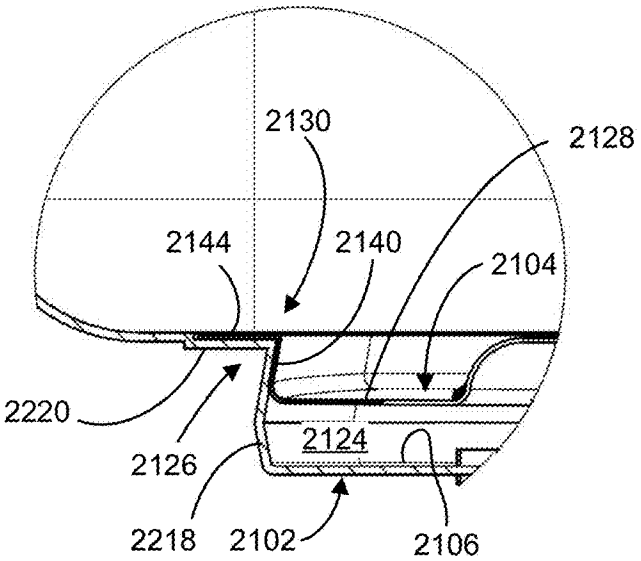
FIG. 12A is an enlarged view of a portion of the container identified at circle 12A of FIG. 12.

Referring to FIGS. 12 and 12A, the base 2102 further includes a reservoir sidewall 2218 extending about and upward from a perimeter of the reservoir bottom panel 2106, a base shoulder 2220 extending laterally outward from an upper end of the reservoir sidewall 2218, and a base upper sidewall 2186 extending upward from a laterally outer edge of the base shoulder 2220. At least a lower portion of reservoir sidewall 2218 and the reservoir bottom panel 2106 enclose, laterally and from below, a liquid collection reservoir 2124. In the example illustrated, the liquid collection reservoir is enclosed, laterally by the lower portion of the reservoir sidewall 2218, and from below by the reservoir bottom panel 2106. The base upper sidewall 2186, in the example illustrated, further includes a base rim 2194.

At least the lower portion of the reservoir sidewall 2218 is spaced laterally inwardly from the base upper sidewall 2186 by a lateral distance 2222. As will be discussed subsequently herein, the lateral distance 2222 between the lower portion of the reservoir sidewall 2218 and the base upper sidewall 2186 helps to impede visual access to liquid in the liquid collection reservoir 2124.

In the example illustrated, the base lower peripheral engagement surface 2126 includes an upper portion of the reservoir sidewall 2218 and a laterally inner portion of the base shoulder 2220 (FIG. 12A). In the example illustrated, the base 2102 is without a peripheral bead that encircles a perimeter of the reservoir bottom panel 2106 (like the peripheral bead 108 of the base 102).

The insert 2104 includes a support panel 2128 with at least one drain aperture 2132, an insert lower sidewall 2140, a lower flange 2144, and an insert lower peripheral engagement surface 2130, like those of the insert 104 of the container 100. In the example illustrated, the insert 2104 is a low-profile insert, without an insert upper sidewall (like the insert upper sidewall 174) extending upward from the flange 2144 to an upper end of the container 2100. The insert 2104 is also without an insert upper peripheral engagement surface (like the insert upper peripheral engagement surface 184). In the example illustrated, the support panel 2128 further includes a depression 2170 associated with each drain aperture 2132, like the depression 170 of support panel 128 (FIG. 12).

In the example illustrated, the base 2102 further includes a flow regulator 2150 for each drain aperture 2132 of the insert 2104, like the flow regulator 150 of the base 102 (FIG. 11).

For use, the insert 2104 is assembled onto the base 2102 by pressing the insert lower peripheral engagement surface 2130 into snap-fit, interlocking sealed engagement with the base lower peripheral engagement surface 2126 (FIGS. 12 and 12A). A food item can be loaded onto the support panel 2128 of the insert 2104, and plastic wrap or a lid can be installed to cover the top of the container 2100. Liquid exuded from the food item can drain into the liquid collection reservoir 2124, where it is isolated from the food item, and obscured from view by at least the lateral distance between the lower portion of the reservoir sidewall 2218 and the base upper sidewall 2186.

When the insert 2104 is assembled onto the base 2102, a vertical distance 2223 extends between the reservoir bottom panel 2106 and an underside surface of the support panel 2128. The lateral distance 2222 between the lower portion of the reservoir sidewall 2218 and the base upper sidewall 2186 is at least as great as the vertical distance 2223 between the reservoir bottom panel 2106 and the underside surface of the support panel 2128 (FIG. 12). Such a configuration helps to impede visual access to liquid in the liquid collection reservoir 2124 when the insert 2104 is assembled onto the base 2102. In the example illustrated, the lateral distance 2222 between the lower portion of the reservoir sidewall 2218 and the base upper sidewall 2186 is about three times greater than the vertical distance 2223 between the reservoir bottom panel 2106 and the underside surface of the support panel 2128.

After use, the insert 2104 can be separated from the base 2102 by disengaging the releasable engagement surfaces 2126, 2130. The insert 2104 and the base 2102 can then be rinsed and delivered to a recycling process.

Referring to FIGS. 13-15A, another example of a container 3100 according to aspects of the present teaching has some similarity to the container 100, with like features identified by like reference characters, incremented by 3000.

Figure 14:
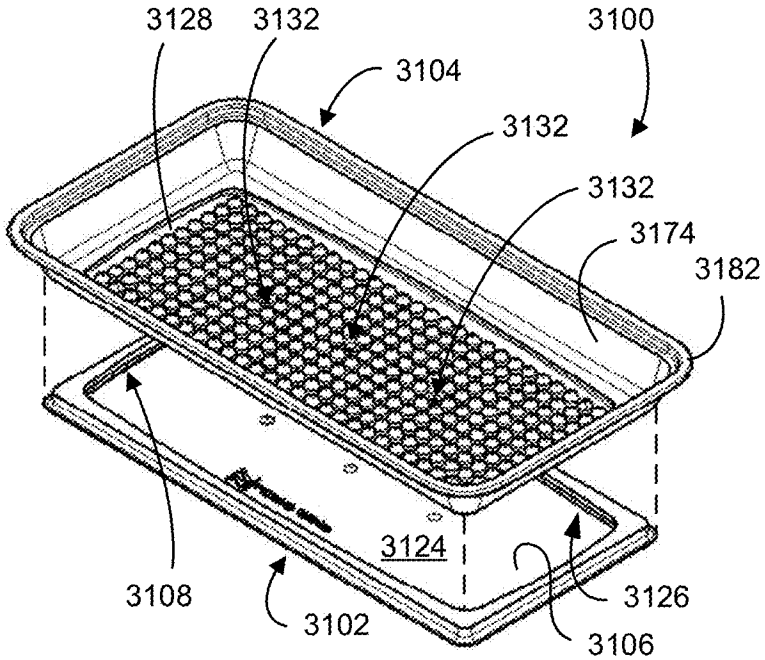
FIG. 14 is an exploded perspective view of the container of FIG. 13.
Figure 13:
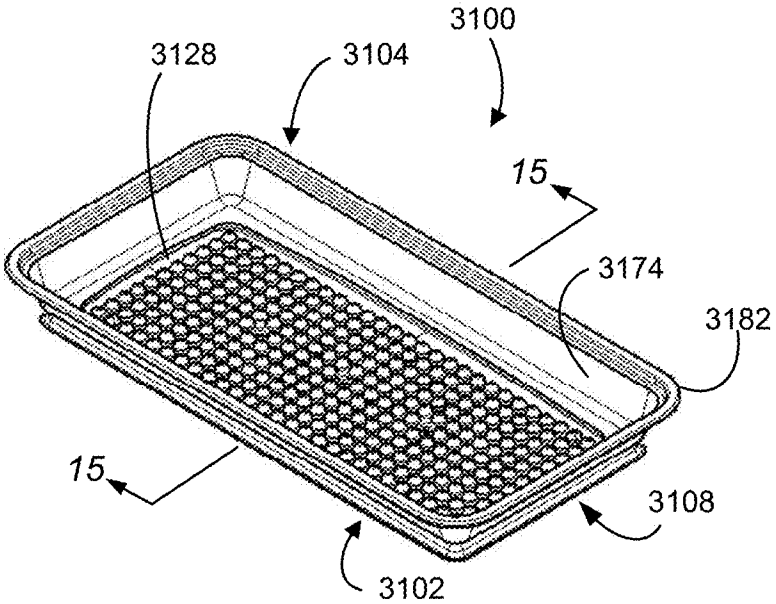
FIG. 13 is a perspective view of another example container for food items according to aspects of the teaching disclosed herein.

Referring to FIG. 14, the container 3100 includes a base 3102 and an insert 3104. In the example illustrated, the base 3102 includes a reservoir bottom panel 3106, a peripheral bead 3108, and a base lower peripheral engagement surface 3126, like those of the base 102 of the container 100. The base 3102, in the example illustrated, is a low-profile base, without an upwardly extending base sidewall (e.g., like base sidewall 186 of the container 100).

The insert 3104 includes a support panel 3128 with at least one drain aperture 3132, an insert lower sidewall 3140, an insert lower flange 3144, and an insert lower peripheral engagement surface 3130. In the example illustrated, the insert 3104 further includes an insert upper sidewall 3174 with an insert rim 3182.

Figure 15:
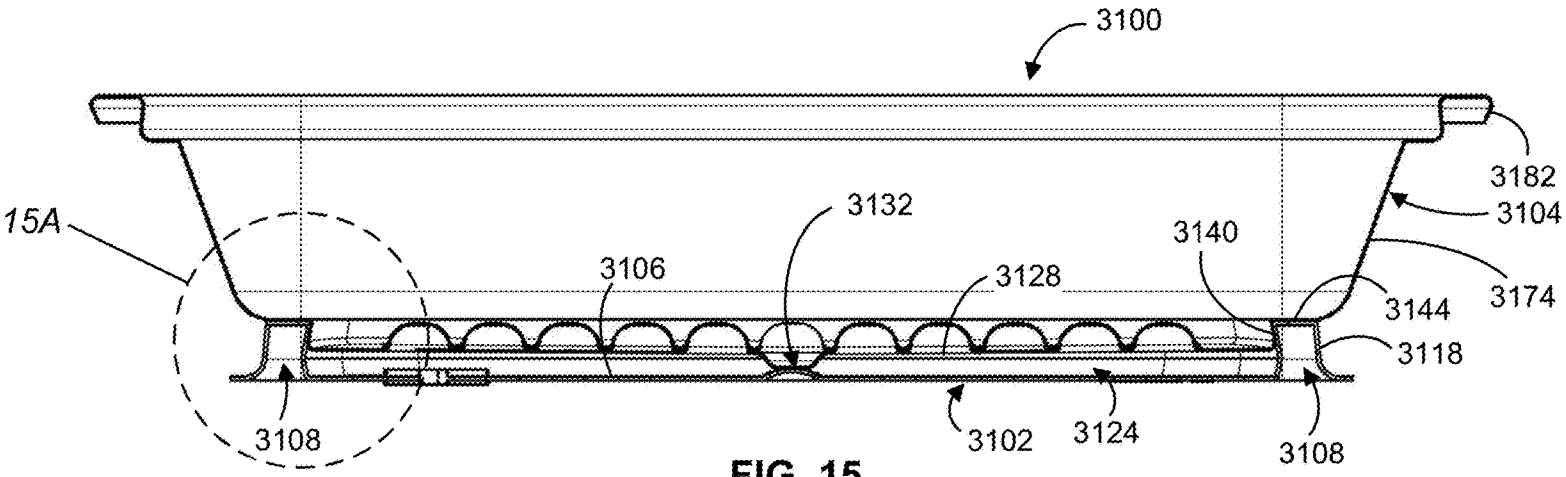
FIG. 15 is a cross-sectional view of the container of FIG. 13 taken along line 15-15.
Figure 15A:
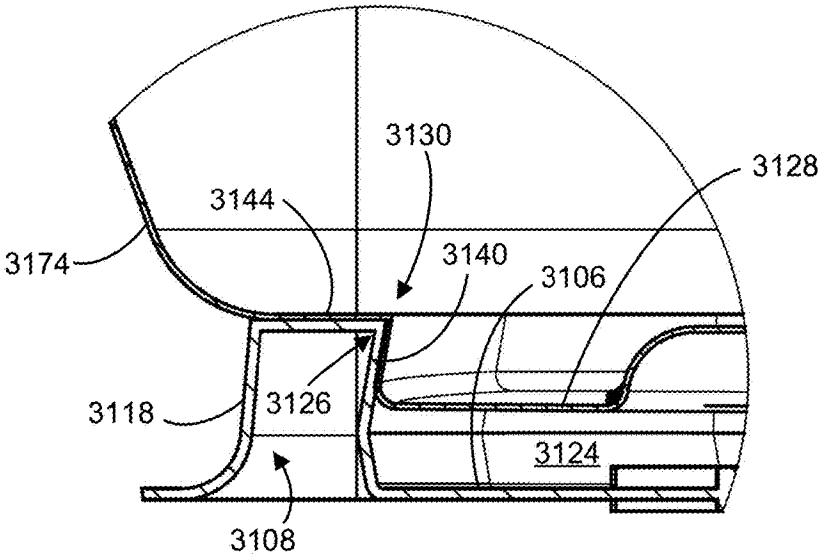
FIG. 15A is an enlarged view of a portion of the container identified at circle 15A of FIG. 15.

For use, the insert 3104 is assembled onto the base 3102 by pressing the insert lower peripheral engagement surface 3130 into snap-fit, interlocking sealed engagement with the base lower peripheral engagement surface 3126 (FIGS. 15 and 15A). A food item can be loaded onto the support panel 3128 of the insert 3104, and plastic wrap or a lid can be installed to cover the top of the container 3100. Liquid exuded from the food item can drain into the liquid collection reservoir 3124, where it is isolated from the food item, and obscured from view by at least the bead outer sidewalls 3118 of the peripheral bead 3108.

After use, the insert 3104 can be separated from the base 3102 by disengaging the releasable engagement surfaces 3126, 3130. The insert 3104 and the base 3102 can then be rinsed and delivered to a recycling process.

Figure 16:
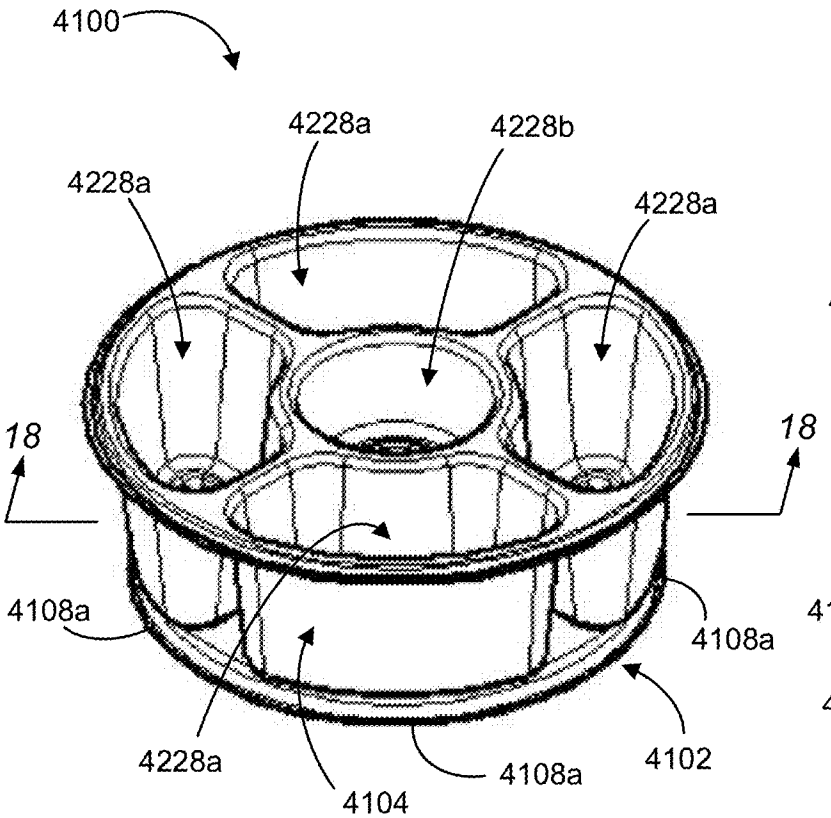
FIG. 16 is a perspective view of another example container for food items according to aspects of the teaching disclosed herein.

Referring to FIG. 16, another example of a container 4100 in accordance to aspects of the present teaching has some similarity to the container 100, with like features identified by like reference characters, incremented by 4000.

Figure 17:
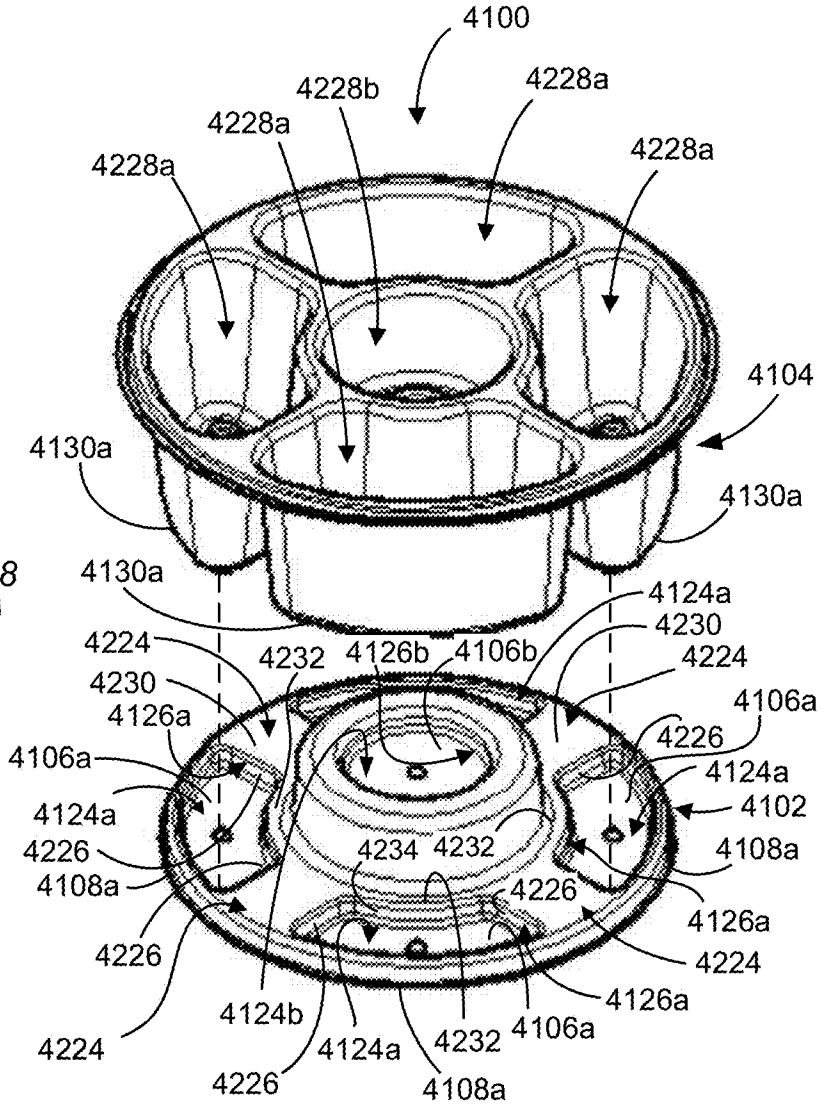
FIG. 17 is an exploded perspective view of the container of FIG. 16.

Referring also to FIG. 17, the container 4100 includes a base 4102 and an insert 4104. In the example illustrated, the container 4100 has multiple food receiving compartments 4228 isolated from one another, and a corresponding liquid collection reservoir 4124 beneath at least one of the compartments. The base 4102 provides a respective base lower peripheral engagement surface 4126 about each of the at least one liquid collection reservoirs 4124, and the insert 4104 provides a respective insert peripheral engagement surface 4130 extending about a lower end of each compartment 4228 that overlies a corresponding one of the at least one liquid collection reservoirs 4124. Each respective insert lower peripheral engagement surface 4130 is releasably inter-lockable with the corresponding base lower peripheral engagement surface 4126 to assemble the insert 4104 in sealed interlocking engagement with the base 4102 about the periphery of each liquid collection reservoir 4124.

More particularly, in the example illustrated, the container 4100 has five compartments including four outer compartments 4228*a* spaced apart circumferentially from one another about a central compartment 4228*b*. The base 4102 in the example illustrated has five liquid collection reservoirs 4124, including four outer liquid collection reservoirs 4124*a* spaced circumferentially about one central liquid collection reservoir 4124*b*.

In the example illustrated, the base 4102 includes a respective reservoir bottom panel 4106*a*, 4106*b* for enclosing each corresponding liquid collection reservoir 4124*a*, 4124*b* from below. More particularly, in the example illustrated, the base 4102 includes a central bottom panel 4106*b* (FIG. 17) that forms a lower surface of the central liquid collection reservoir 4124*b*. In the example illustrated, the central bottom panel 4106*b* is generally circular in shape when viewed from above. The base 4102 further includes a central peripheral bead 4108*b* having a central bead inner sidewall 4110*b* extending upward from a perimeter of the central bottom panel 4106*b*, a central bead top wall 4114*b* extending laterally outward from an upper end of the central bead inner sidewall 4110*b*, and a central bead outer sidewall 4118*b* extending downward from a laterally outer edge of the central bead top wall 4114*b*. At least a lower portion of the central bead inner sidewall 4110*b* laterally encloses the central liquid collection reservoir 4124*b*. The base 4102 further includes a central base peripheral engagement surface 4126*b* that extends about the central liquid collection reservoir 4124*b*, and that, in the example illustrated, comprises an upper portion of the central peripheral bead inner sidewall 4110*b*.

The insert 4104 includes a central compartment support panel 4128*b* disposed at a lower end of the central compartment 4228*b* and having a central insert peripheral engagement surface 4130*b* releasably inter-lockable with the central base peripheral engagement surface 4126*b*. The central support panel 4128*b* includes at least one aperture 4132 for draining liquid from above into the central liquid collection reservoir 4124*b*.

In the example illustrated, the base 4102 includes four outer bottom panels 4106*a* (FIG. 17) that each form a lower surface of a respective one of the liquid collection reservoirs 4124*a*. In the example illustrated, each outer bottom panel 4106*b* is generally kidney-shaped when viewed from above. The outer (circumferential) liquid collection reservoirs 4124*a* are, in the example illustrated, separated by radially extending webs 4224 (FIG. 17) each having spaced apart web sidewalls 4226 extending upward from circumferential ends of adjacent bottom panels 4106*a*, and a web top wall 4230 extending laterally between upper ends of the web sidewalls 4226.

Figure 18:
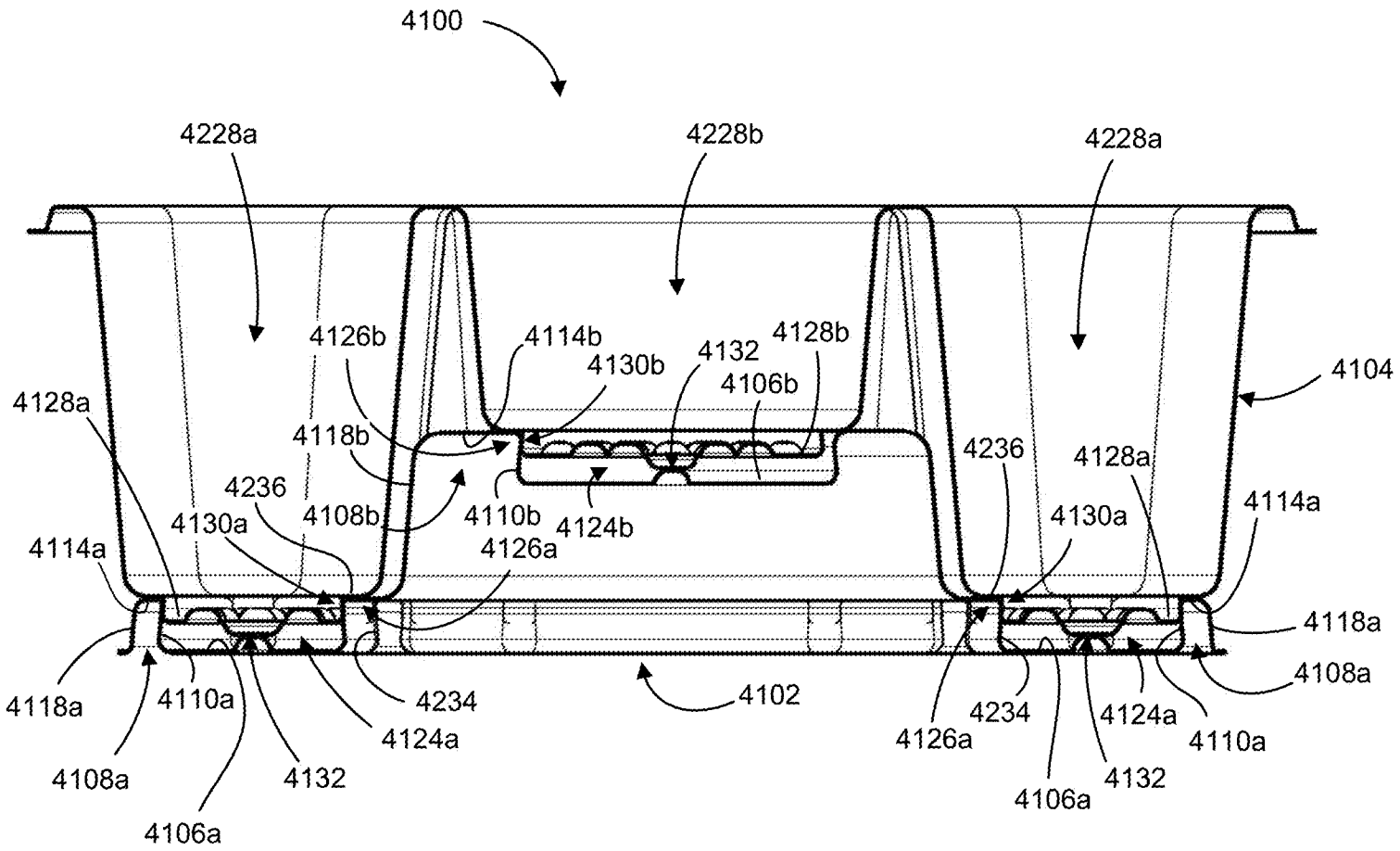
FIG. 18 is a cross-sectional view of the container of FIG. 16 taken along line 18-18.
Figure 19:
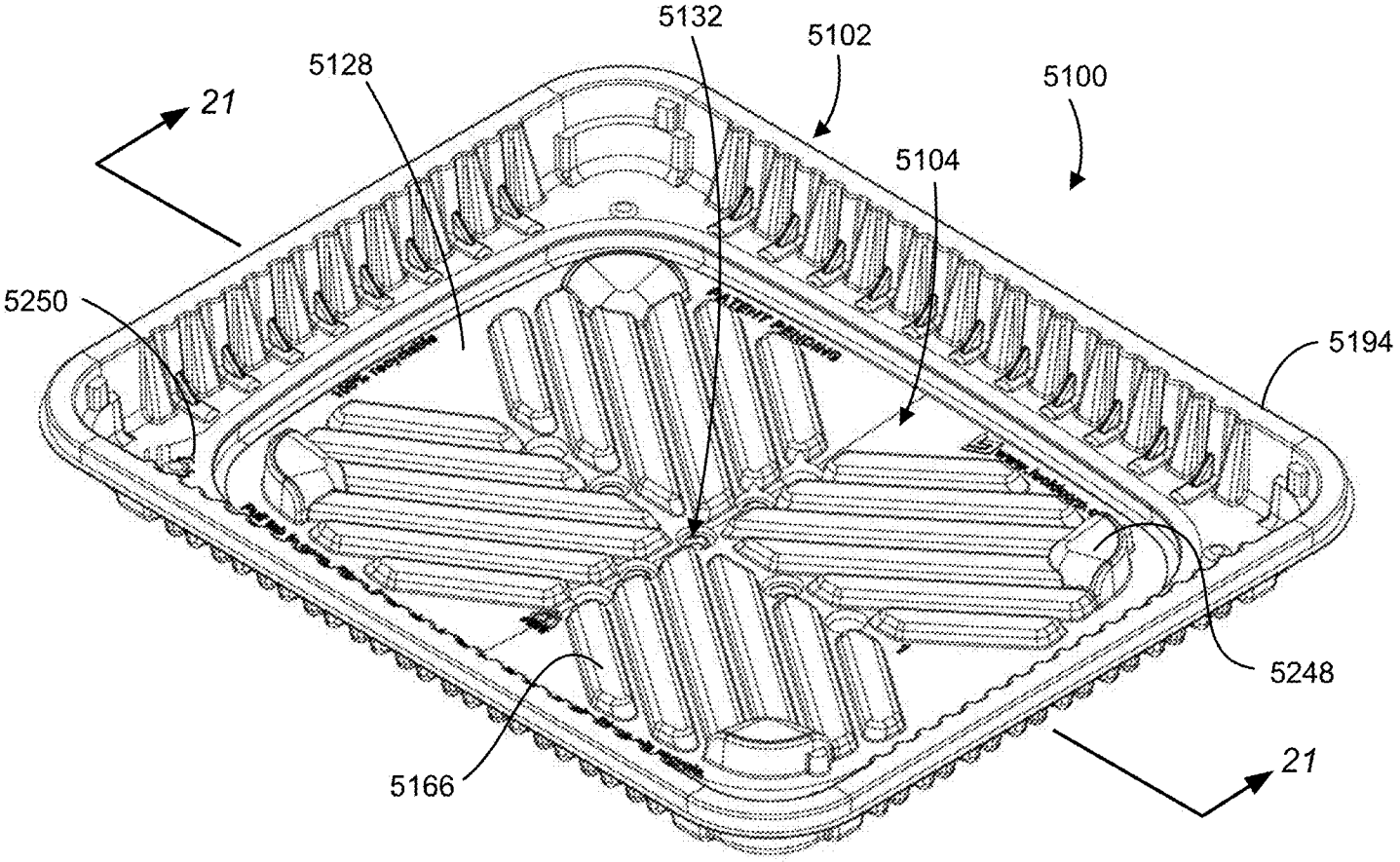
FIG. 19 is a perspective view of another container for food items according to aspects of the teaching disclosed herein.

The base 4102 further includes a plurality of outer peripheral bead segments 4108*a* each having an outer bead inner sidewall 4110*a* extending upward from a perimeter segment of the outer bottom panel 4106*a*, an outer bead top wall 4114*a* extending laterally outward from an upper end of the outer bead inner sidewall 4110*a*, and an outer bead outer sidewall 4118*a* extending downward from a laterally outer edge of the central bead top wall 4114*a*. At least a lower portion of the outer bead inner sidewall 4110*a* laterally encloses the outer liquid collection reservoir 4124*a* (FIG. 18). The peripheral bead segments 4108*a* can impede visual access to liquid in the respective outer liquid collection reservoir 4124*a*. In particular, the outer bead outer sidewall 4118*a* positioned laterally outward of the outer bead inner sidewall 4110*a* can help to conceal liquid in the respective liquid collection reservoir 4124*a* by impeding visual access to such liquid.

The base 4102 further includes a plurality of circumferentially extending web segments 4232 each having a web inner sidewall 4234 extending upward from a radially inward perimeter segment of the outer bottom panel 4106*a*, and a web upper wall 4236 (FIG. 18) extending laterally inward from an upper end of the web inner sidewall 4234. Circumferentially opposed ends of the web inner sidewall 4234 adjoin a respective web sidewall 4226 of the radially extending web 4224 (FIG. 17). At least a lower portion of the web inner sidewall 4234 and opposed web sidewalls 4226 laterally enclose the outer liquid collection reservoir 4124*a*.

The base 4102 further includes a respective outer base peripheral engagement surface 4126*a* that extends about a corresponding outer liquid collection reservoir 4124*a*, and that, in the example illustrated, comprises an upper portion of each of the outer peripheral bead inner sidewall 4110*a*, the web inner sidewall 4234 and the opposed web sidewalls 4226.

The insert 4104 includes a respective outer compartment support panel 4128*a* disposed at a lower end of each corresponding outer compartment 4126*a* and having an outer insert peripheral engagement surface 4130*a*, each of which is releasably inter-lockable with a corresponding outer base peripheral engagement surface 4126*a*. Each outer support panel 4128*a* includes at least one aperture 4132 for draining liquid from above into the corresponding outer liquid collection reservoir 4124*a* therebelow.

For use, the insert 4104 is assembled onto the base 4102 by pressing the insert peripheral engagement surfaces 4130 into snap-fit, interlocking sealed engagement with respective base peripheral engagement surfaces 4126 (FIG. 18). The same or a different food item can be loaded onto each support panel 4128*a*, 4128*b* of the insert 4104, and plastic wrap or a lid can be installed to cover the top of the container 4100. Liquid exuded from each food item can drain into the respective liquid collection reservoir 4124*a*, 4124*b* located below that food item, where it is isolated from the food item. Liquid collected in outer liquid collection reservoirs 4124*a* is obscured from view by at least the outer bead outer sidewall 4118*a* of the respective outer peripheral bead segment 4108*a*. Liquid collected in the central liquid collection reservoir 4124*b* is obscured from view by at least the central bead outer sidewall 4118*b* of the central peripheral bead segment 4108*b*.

After use, the insert 4104 can be separated from the base 4102 by disengaging the releasable engagement surfaces 4126, 4130. The insert 4104 and the base 4102 can then be rinsed and delivered to a recycling process.

Referring to FIGS. 19-21A, another example of a container 5100 according to aspects of the present teaching has some similarity to the container 2100, with like features identified by like reference characters, incremented by 3000.

Figure 20:
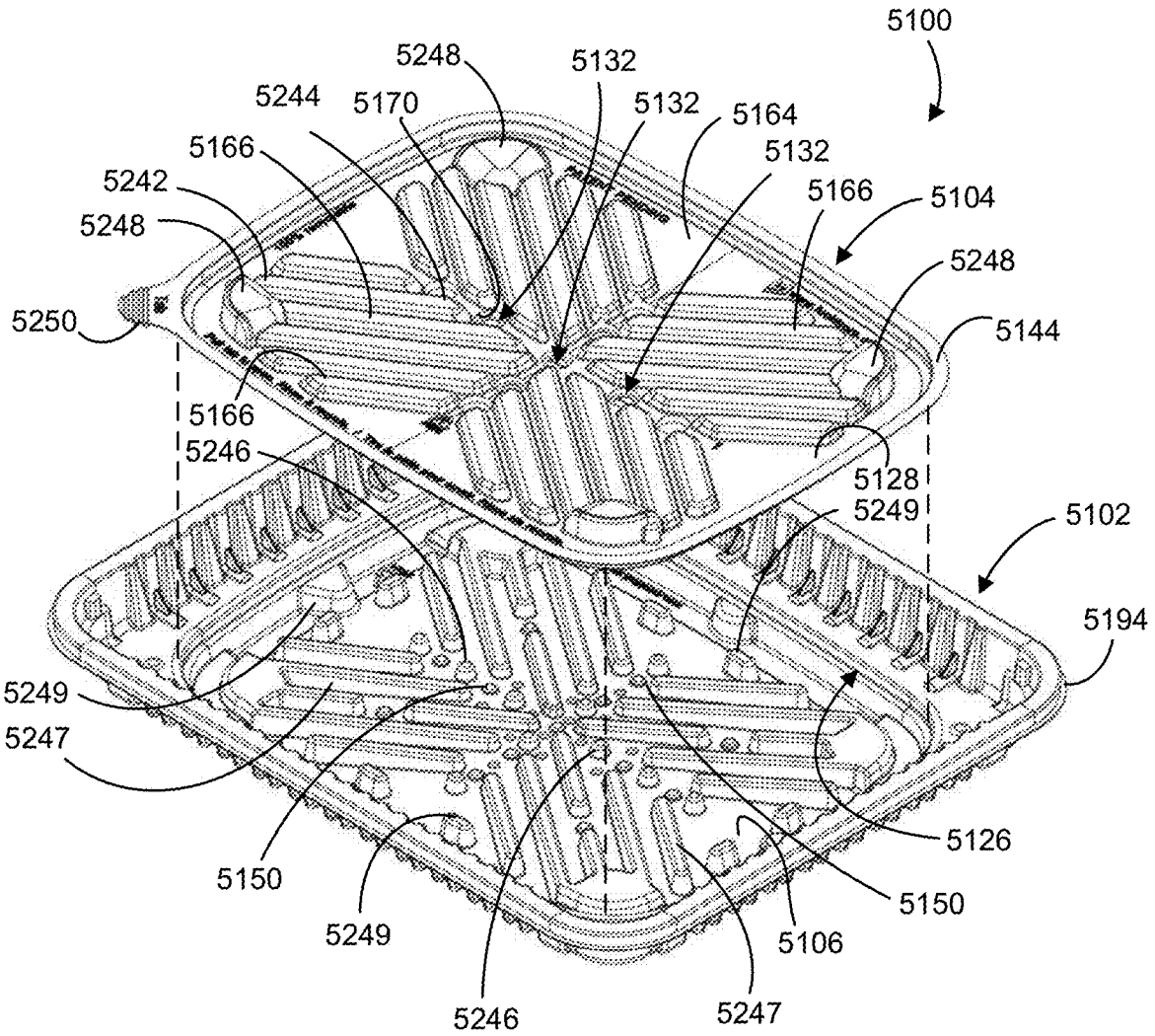
FIG. 20 is an exploded perspective view of the container of FIG. 19.

Referring to FIG. 20, the container 5100 includes a base 5102 and an insert 5104. In the example illustrated, the base 5102 includes a reservoir bottom panel 5106 and a base lower peripheral engagement surface 5126, like those of the base 2102 of container 2100.

Figure 21:
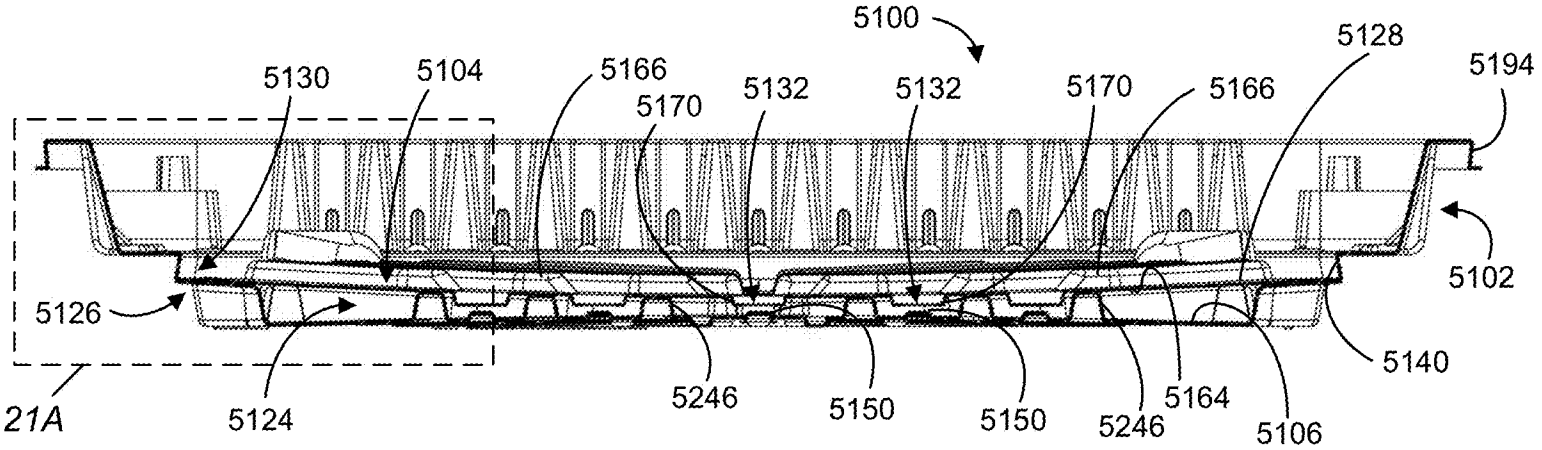
FIG. 21 is a cross-sectional view of the container of FIG. 19 taken along line 21-21.
Figure 21A:
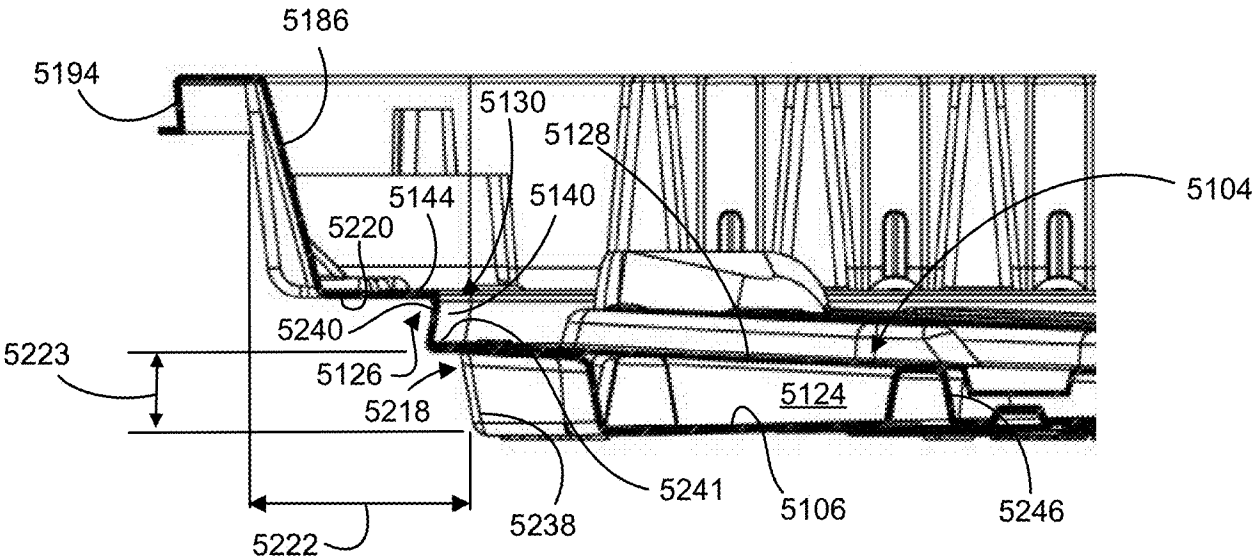
FIG. 21A is an enlarged view of a portion of the container identified at box 21A of FIG. 21.

Referring to FIG. 21A, the base 5102 further includes a reservoir sidewall 5218 extending about and upward from a perimeter of the reservoir bottom panel 5106, a base shoulder 5220 extending laterally outward from an upper end of the reservoir sidewall 5218, and a base upper sidewall 5186 extending upward from a laterally outer edge of the base shoulder 5220. In the example illustrated, the reservoir sidewall 5218 and the reservoir bottom panel 5106 enclose, laterally and from below, a liquid collection reservoir 5124. In the example illustrated, the base upper sidewall 5186 further includes a base rim 5194.

At least a lower portion 5238 of the reservoir sidewall 5218 is spaced laterally inwardly from the base upper sidewall 5186 by a lateral distance. In the example illustrated, the lower portion 5238 reservoir sidewall 5218 is spaced laterally inwardly from the base upper sidewall 5186 by a lateral distance 5222. The lateral distance 5222 between the reservoir sidewall 5218 and the base upper sidewall 5186 can help to impede visual access to liquid in the liquid collection reservoir 5124.

In the example illustrated, the reservoir sidewall 5218 includes an upper portion 5240 disposed laterally outward of the lower portion 5238 and connected to the lower portion 5238 by a generally horizontal step surface 5241. The step surface 5241 engages the underside surface of the insert 5204 when the insert 5204 is assembled onto the base 5202.

With reference to FIG. 21A, the upper portion 5240 of the reservoir sidewall 5218 extends downward from the base shoulder 5220 to a laterally outer edge of the step surface 5241. The lower portion 5238 of the reservoir sidewall 5218 extends downward from a laterally inner edge of the step surface 5241 to the reservoir bottom panel 5106.

In the example illustrated, the base lower peripheral engagement surface 5126 includes the step surface 5241 and the upper portion 5240 of the reservoir sidewall 5218 (FIG. 21A). In example illustrated, the base 5102 is without a peripheral bead that encircles a perimeter of the reservoir bottom panel 5106 (like the peripheral bead 108 of the base 102).

With reference to FIGS. 20 and 21A, the insert 5104 includes a support panel 5128 with at least one drain aperture 5132, an insert lower sidewall 5140, a lower flange 5144, and an insert lower peripheral engagement surface 5130, like those of the insert 2104 of the container 2100. In the example illustrated, the insert lower peripheral engagement surface 5130 includes an underside surface of a peripheral portion of the support panel 5128 configured to bear against the step surface 5241.

In the example illustrated, the insert lower peripheral engagement surface 5130 includes the insert lower sidewall 5140 and a peripheral portion of the support panel 5128 (FIG. 21A). The insert lower engagement surface 5130 further includes, in the example illustrated, an outer surface of the insert lower sidewall 5140 configured to bear against the upper portion 5240 of the reservoir sidewall 5218.

In the example illustrated, the insert 5104 is a low-profile insert, without an insert upper sidewall (like the insert upper sidewall 174) extending upward from the flange 5144 to an upper end of the container 5100. The insert 5104 is also without an insert upper peripheral engagement surface (like the insert upper peripheral engagement surface 184).

With reference to FIGS. 20 and 21, in the example illustrated, the support panel 5128 further includes a depression 5170 associated with each drain aperture 5132, like the depressions 2170 of support panel 2128. The base 5102, in the example illustrated, further includes a flow regulator 5150 for each drain aperture 5132 of the insert 5104, like the flow regulators 2150 of the base 2102.

Referring again to FIG. 20, in the example illustrated, the support panel 5128 has nine drain apertures 5132 for draining liquid from above into the liquid collection reservoir 5124. Five of the drain apertures 5132 are, in the example illustrated, spaced apart along a longitudinal centerline of the support panel 5128. In the example illustrated, the four remaining drain apertures 5132 are spaced apart along a lateral centerline of the support panel 5128 that extends through a central one of the five longitudinally spaced apart drain apertures 5132. Two of the four laterally spaced apart drain apertures 5132 are located on each side of the longitudinal centerline.

Referring still to FIG. 20, in the example illustrated, the support panel 5128 includes a panel upper surface 5164 and a plurality of spaced-apart risers 5166 projecting upward from the panel upper surface 5164. The risers 5166 each have a riser top surface spaced above the panel upper surface 5164 for holding food items in the container 5100 above the panel upper surface 5164. In the example illustrated, the risers 5166 are elongated compared to the risers 166 of the container 100 (FIG. 2). Each riser 5166 extends, in the example illustrated, from a riser first end 5242 located proximate the perimeter of the support panel 5128 to a riser second end 5244 located proximate a respective one of the drain apertures 5132. In the example illustrated, the panel upper surface 5164 between the risers is generally flat and inclined toward the drain apertures 5132. Such a configuration can facilitate flow of liquid from the food items along the panel upper surface 5164 between the elongated risers 5166 toward one or more of the drain apertures 5132.

In the example illustrated, the base 5102 includes a plurality of spaced-apart panel braces 5246. Each panel brace 5246 projects upwardly from the reservoir bottom panel 5106 and is generally cylindrical in shape. When the insert 5104 is assembled onto the base 5102 (FIGS. 21 and 21A) and one or more food items are loaded on the support panel 5128, the panel braces 5246 can assist in maintaining a vertical separation between the support panel 5128 and the reservoir bottom panel 5106 by abutting an underside surface of the support panel 5128. Maintaining the vertical separation between the support panel 5128 and the reservoir bottom panel 5106 can prevent the reservoir bottom panel 5106 from impeding flow of liquid into the liquid collection reservoir 5124 through the drain apertures 5132. The capacity of the liquid collection reservoir 5124 could decrease if the support panel 5128 were permitted to sag under the load of food items. Maintaining the vertical separation between the support panel 5128 and the reservoir bottom panel 5106 can also preserve the capacity of the liquid collection reservoir 5124 when the support panel 5128 is under load.

Referring again to FIG. 20, in the example illustrated, some of the panel braces 5246 are positioned proximate to flow regulators 5150 on the reservoir bottom panel 5106. When the insert 5104 is assembled onto the base 5102, these panel braces 5246 abut the underside surface of the support panel 5128 proximate one or more of the drain apertures 5132. Such a configuration can further ensure there is a vertical separation between the drain apertures 5132 and the reservoir bottom panel 5106 to allow liquid exuded from the food items to pass into the liquid collection reservoir 5124.

In some examples, the base 5102 includes additional structural elements for maintaining the vertical separation between the support panel 5128 and the reservoir bottom panel 5106 when the insert 5104 is assembled onto the base 5102. In the example illustrated, the base 5102 includes a plurality of elongate panel braces 5247 that project upwardly from the reservoir bottom panel 5106. Each elongate panel brace 5247 has a rounded top surface that abuts the underside surface of the support panel 5128 between adjacent risers 5166 when the insert 5104 is assembled onto the base 5102. In the example illustrated, the base 5102 also includes plurality of supplemental panel braces 5249 that are generally spaced apart about the perimeter of the reservoir bottom panel 5106. The supplemental panel braces 5249 project upwardly from the reservoir bottom panel 5106 and abut the underside surface of the support panel 5128 when the insert 5104 is assembled onto the base 5102. When the insert 5104 is assembled onto the base 5102 and one or more food items are loaded on the support panel 5128, the panel braces 5247, 5249 can further assist in maintaining a vertical separation between the support panel 5128 and the reservoir bottom panel 5106 by abutting the underside surface of the support panel 5128.

Referring to FIG. 21, in the example illustrated, an elevation of the support panel 5128 proximate the insert lower sidewall 5140 is higher than an elevation of the support panel 5128 at the drain apertures 5132. Such a configuration facilitates the flow of exuded liquid along the panel upper surface 5164 to the drain apertures 5132. In cases where the container 5100 is inverted, such a configuration may also impede the collected liquid from flowing along a lower surface of the support panel 5128 to the one or more drain apertures 5132 (i.e., because the lower panel surface slopes away from the drain apertures 5132 when the container 5100 in inverted).

In the example illustrated, the step surface 5241 supports a peripheral portion of the support panel 5128 from below when the insert 5104 is assembled onto the base 5102. This engagement can help maintain a vertical separation between the support panel 5128 and the reservoir bottom panel 5106 about the perimeter of the liquid collection reservoir 5124.

Referring again to FIG. 20, the insert 5104 includes optional nesting features that facilitate stacking of the containers. In the example illustrated, the insert 5104 includes four nesting members 5248 in the form of raised wedge-shaped projections. Each of the nesting members 5248 projects upwardly from the panel upper surface 5164 proximate a respective corner of the support panel 5128. The nesting members 5248 each have a top surface. The top surface of each nesting member 5248 is at a higher elevation than i) the top surface of each riser 5166 and ii) the lower flange 5144 of the insert 5104. When multiple containers 5100 are stacked together, the nesting members 5248 of a lower container 5100 in the stack abuts an underside surface of the reservoir bottom panel 5106 of the container 5100 directly above. The nesting members 5248 can assist in keeping a stack of containers straight when one container 5100 is dropped on another during manufacturing. In some examples, the underside surface of the reservoir bottom panel 5106 has corresponding female nesting members that engage the male nesting members 5248 of the above container 5100. Such an engagement may further improve the stability of a stack of containers.

For use, the insert 5104 is assembled onto the base 5102 by pressing the insert lower peripheral engagement surface 5130 into snap-fit, interlocking sealed engagement with the base lower peripheral engagement surface 5126 (FIG. 21A). A food item can be loaded onto the support panel 5128 of the insert 5104, and plastic wrap or a lid can be installed to cover the top of the container 5100. Liquid exuded from the food item can drain into the liquid collection reservoir 5124.

In the example illustrated, snap-fit interlocking assembly of the base and insert lower peripheral engagement surfaces 5126, 5130 is facilitated by having the upper end of the base intermediate sidewall 5240 define (or bound) an opening that is slightly smaller than a footprint defining the lower edge of the insert lower sidewall 5140. To assemble the insert 5104 onto the base 5102, the lower edge of the insert lower sidewall 5140 can be pressed vertically downward (as viewed in FIG. 21A) against the base 5102 and urged past the upper end of the base intermediate sidewall 5240, resiliently deforming the respective surfaces of the insert and base, until the surfaces pass one another and the base intermediate sidewall 5240 and the insert lower sidewall 5140 snap back toward their undeformed state. Some resilient compressive forces remain upon assembly, so that a generally fluid-tight seal is provided by the interlocking engagement of the lower peripheral engagement surfaces 5126, 5130.

When the insert 5104 is assembled onto the base 5102, a vertical distance extends 5223 between the reservoir bottom panel 5106 and the underside surface of the support panel 5128. The lateral distance 5222 between the lower portion 5238 of the reservoir sidewall 5218 and the base upper sidewall 5186 is at least as great as the vertical distance 5223 between the reservoir bottom panel 5106 and the underside surface of the support panel 5128. Such a configuration helps to impede visual access to liquid in the liquid collection reservoir 5124 when the insert 5104 is assembled onto the base 5102. In the example illustrated, the lateral distance 5222 between the lower portion 5238 of the reservoir sidewall 5218 and the base upper sidewall 5186 is about two times greater than the vertical distance 5223 between the reservoir bottom panel 5106 and the underside surface of the support panel 5128 (FIG. 21A).

After use, the insert 5104 can be separated from the base 5102 by disengaging the releasable engagement surfaces 5126, 5130. The insert 5104 and the base 5102 can then be rinsed and delivered to a recycling process. Referring to FIG. 20, in the example illustrated, the insert 5104 includes an optional user pull tab 5250 to facilitate separation of the insert 5104 and the base 5102. Urging the user pull tab 5250 in a direction away from the reservoir bottom panel 5106 can overcome the compressive forces between the lower peripheral engagement surfaces 5126, 5130 and resiliently deforms the insert 5104, which gives the insert lower sidewall 5140 clearance to disengage the upper portion 5240 of the reservoir sidewall 5218.

Figure 22:
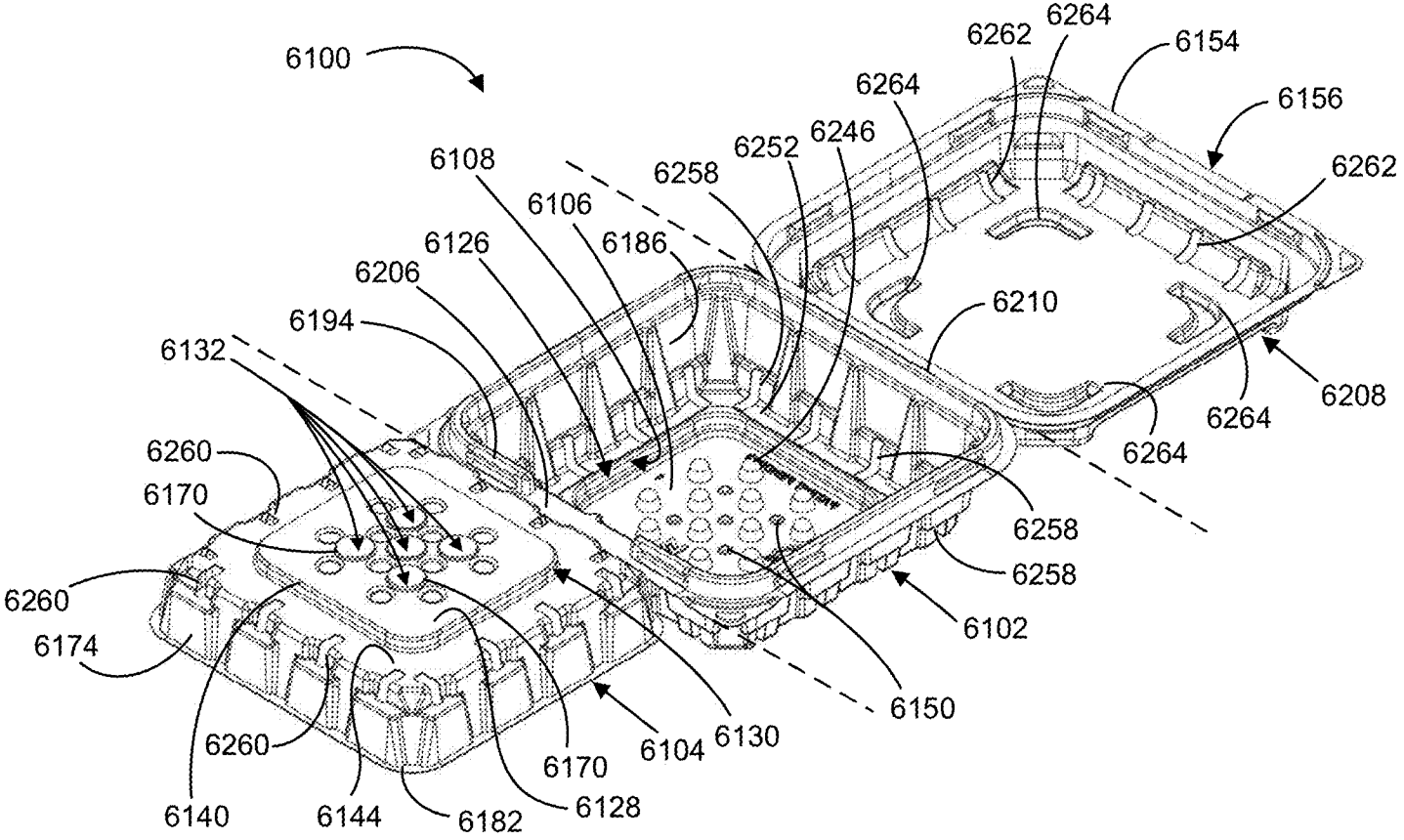
FIG. 22 is a perspective view of another container for food items according to aspects of the teaching disclosed herein.
Figure 23:
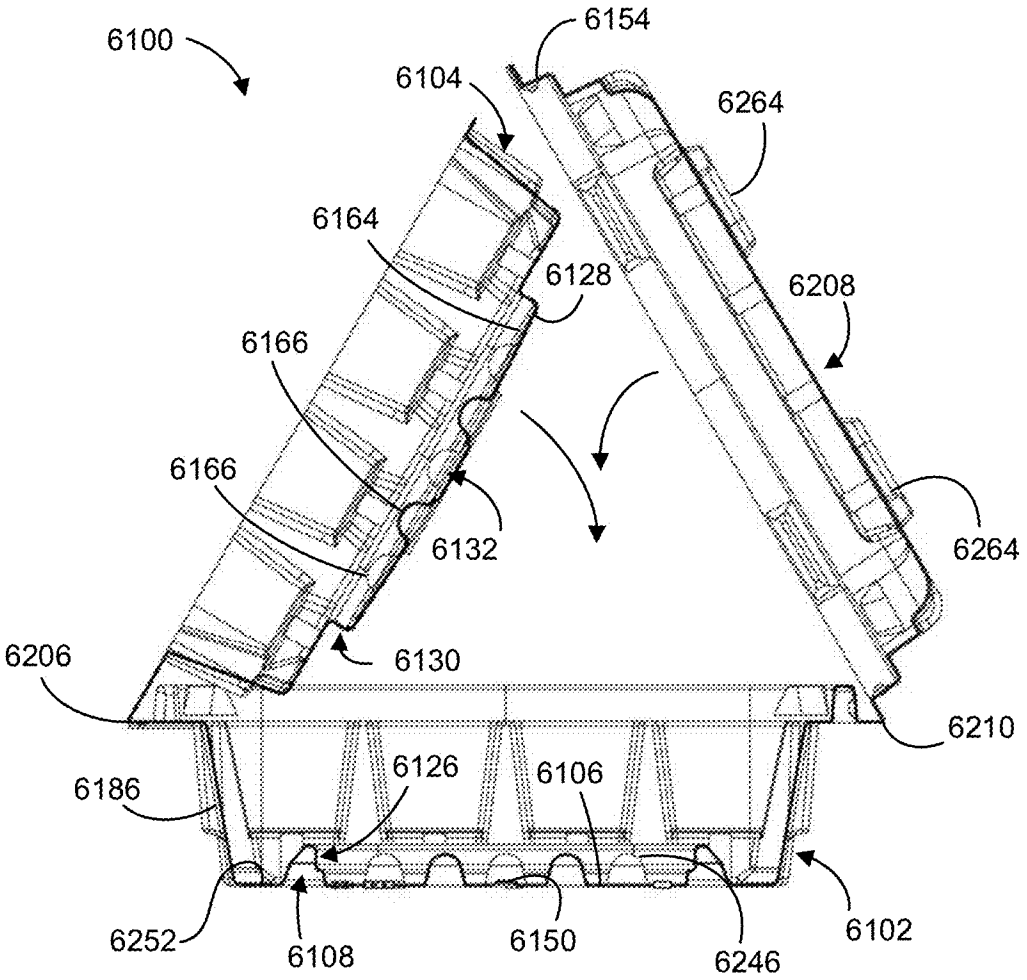
FIG. 23 is a cross-sectional view of the container of FIG. 22 in a partially assembled configuration.
Figure 24:
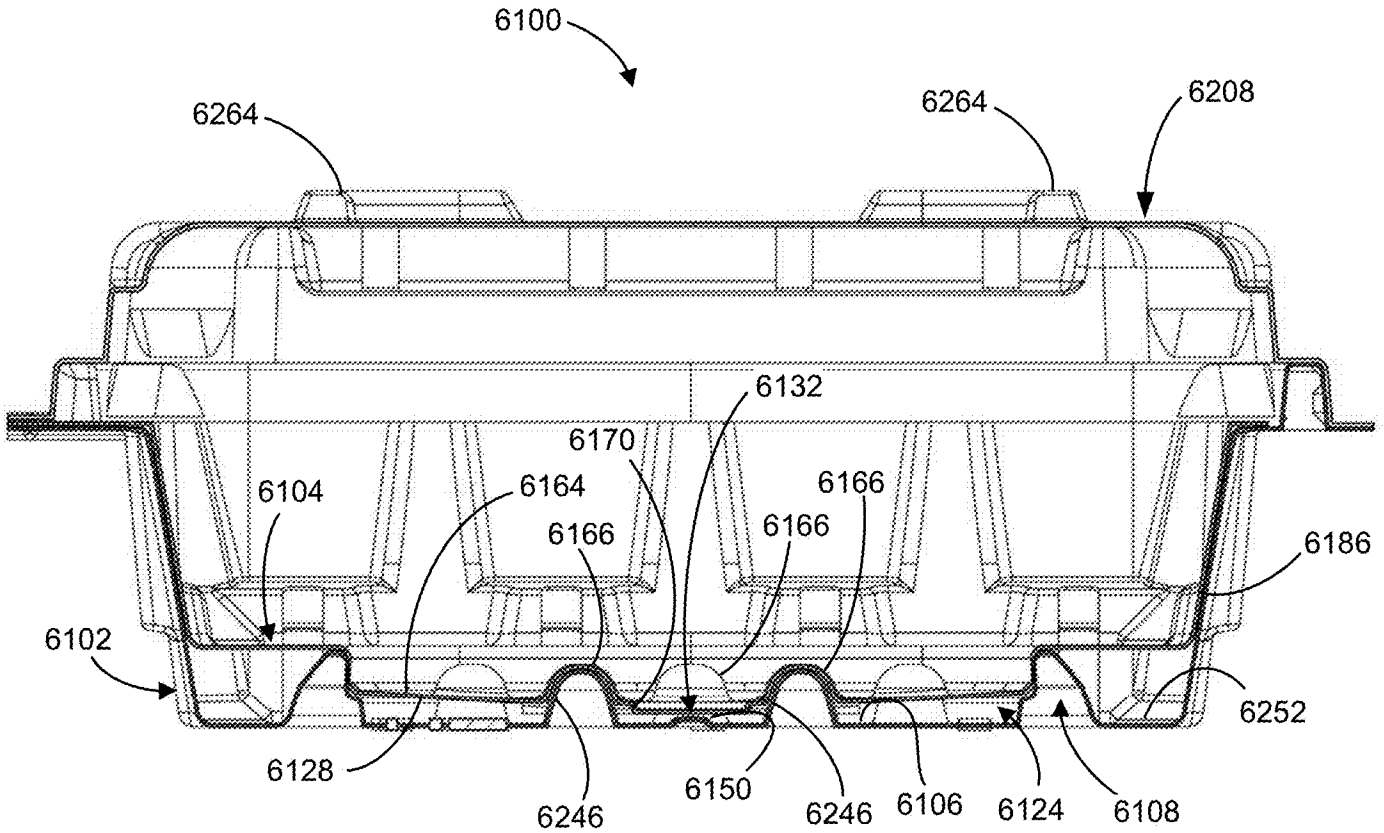
FIG. 24 is a cross-sectional view of the container of FIG. 22 in a fully closed configuration.

Referring to FIGS. 22-24, another example of a container 6100 according to aspects of the present teaching has some similarity to the container 1100, with like features identified by like reference characters, incremented by 5000. The container 6100 includes a base 6102 and an insert 6104 that are formed together from a single sheet of plastic and connected together along a first living hinge 6206. The first living hinge 6206 is formed between respective first upper edges of the base 6102 and the insert 6104.

The base 6102 includes a reservoir bottom panel 6106, a peripheral bead 6108, a base lower peripheral engagement surface 6126, and a base sidewall 6186, like those of the base 102. In the example illustrated, the base sidewall 6186 further includes a base rim 6194. The base 6102, in the example illustrated, is without a base upper peripheral engagement surface (like the base upper peripheral engagement surface 196 of the base 102).

Referring to FIG. 23, in the example illustrated, the base 6102 further includes a base bottom wall 6252 extending laterally between the peripheral bead 6108 and the base sidewall 6186. The base bottom wall 6252 is, in the example illustrated, at equal elevation with the reservoir bottom panel 6106. Such a configuration can enhance stability of the container 6100 when placed on a support surface since both the base bottom wall 6252 and the reservoir bottom panel 6106 can engage the support surface. In the example illustrated, the base bottom wall 6252 increases a lateral separation between the peripheral bead 6108 and a lower portion of the base sidewall 6186. The increased lateral separation between the peripheral bead 6108 and the lower portion of the base sidewall 6186 further impedes visual access to liquid in the liquid collection reservoir 6124.

Referring to FIG. 22, the insert 6104 includes a support panel 6128 with at least one drain aperture 6132, an insert lower sidewall 6140, a lower flange 6144, and an insert lower peripheral engagement surface 6130, like those of the insert 104. In the example illustrated, the insert 6104 is without an insert upper peripheral engagement surface (like the insert upper peripheral engagement surface 184 of the base 102). In the example illustrated, the insert 6104 further includes an insert upper sidewall 6174 with an insert rim 6182.

Assembly of the insert 6104 onto the base 6102 of the container 6100 involves pivoting the insert 6104 relative to the base 6102 about the first living hinge 6206 (FIG. 23). Then the insert 6104 can be releasably secured to the base 6102 by pressing the insert lower peripheral engagement surface 6130 into snap-fit, interlocking sealed engagement with the base lower peripheral engagement surface 6126. The interlocked engagement between the base and insert lower peripheral engagement surfaces 6126, 6130 contribute to preventing liquid from leaking out of the liquid collection reservoir 6124 (FIG. 24).

With reference to FIG. 22, in the example illustrated, the support panel 6128 further includes a depression 6170 associated with each drain aperture 6132, like the depressions 170 of support panel 128. The base 6102, in the example illustrated, further includes a flow regulator 6150 for each drain aperture 6132 of the insert 6104, like the flow regulators 150 of the base 102.

Referring to FIG. 23, in the example illustrated, the support panel 6128 includes a panel upper surface 6164 and a plurality of spaced-apart risers 6166 projecting upward from the panel upper surface 6164. The risers 6166 each have a riser top surface spaced above the panel upper surface 6164 for holding food items in the container 6100 above the panel upper surface 6164. In the example illustrated, the panel upper surface 6164 between the risers 6166 is generally flat and inclined toward the drain apertures 6132. The top surface of each riser 6166 is, in the example illustrated, rounded to facilitate drainage from the food item to the panel upper surface 6164.

In the example illustrated, the risers 6166 have hollow interiors bounded at least in part by concave inner surfaces. The inner surfaces of the risers 6166 are directed toward the reservoir bottom panel 6106 and form a ceiling of the liquid collection reservoir 6124 (FIG. 24). In cases where the container 6100 may be inverted or near-inverted, such as, for example, during handling by a potential purchaser, liquid can collect in the riser interiors which can help prevent liquid from flowing in reverse through the drain apertures 6132, from the (inverted) liquid collection reservoir 6124 back toward the food item in the container 6100.

Referring again to FIG. 22, the base 6102 optionally includes a plurality of spaced-apart panel braces 6246, like the panel braces 5246 of base 5102. Each panel brace 6246 projects upward from the reservoir bottom panel 6106. When the insert 6104 is assembled onto the base 6102 and one or more food items are loaded on the support panel 6128, the panel braces 6246 can assist in maintaining a vertical separation between the support panel 6128 and the reservoir bottom panel 6106 by abutting an underside surface of the support panel 6128. Maintaining the vertical separation between the support panel 6128 and the reservoir bottom panel 6106 can prevent the reservoir bottom panel 6106 from impeding flow of liquid into the liquid collection reservoir 6124 through the drain apertures 6132. The capacity of the liquid collection reservoir 6124 (FIG. 24) could decrease if the support panel 6128 were permitted to sag under the load of food items. Maintaining the vertical separation between the support panel 6128 and the reservoir bottom panel 6106 can also preserve the capacity of the liquid collection reservoir 6124 when the support panel 6128 is under load.

In the example illustrated, the panel braces 6246 each have an upper end spaced above the reservoir bottom panel 6106. The upper end of each panel brace 6246 is, in the example illustrated, sized to fit within the hollow interior of a corresponding one of the risers 6166 of the support panel 6128 when the insert 6104 is assembled onto the base 6102 (FIG. 24). Such engagement between the panel braces 6246 and the risers 6166 can further assist in maintaining the vertical separation between the support panel 6128 and the reservoir bottom panel 6106.

In the example illustrated, the container 6100 further includes an optional lid 6208 having a lid rim 6154 that is releasably engageable with the base rim 6194 to open and close the container 6100. The lid 6208 is, in the example illustrated, formed together with the base 6102 and insert 6104 from the same single sheet of plastic. The lid 6208 is connected to the base 6102 along a second edge of the base 6102 by a second living hinge 6210. The container 6100 can be selectively opened and closed by pivoting the lid 6208 relative to the base 6102 about the second living hinge 6210.

Referring to FIG. 22, in the example illustrated, the base rim 6194 is interrupted by the first living hinge 6206 which connects the base 6102 and the insert 6104. The base rim 6194 does not completely encircle the perimeter of the base 6102 to provide space for the first living hinge 6206. The lid rim 6154 includes an accessibility recess 6156 that aligns with the interruption in the base rim 6194 when the lid 6208 is closed. The accessibility recess 6156 offers a convenient location for a user to grip and open the lid 6208.

The base 6102 optionally includes a plurality of base vents 6258. In the example illustrated, the base vents 6258 are laterally spaced apart about the perimeter of the base 6102. Each base vent 6258, in the example illustrated, has a lower portion formed in the base bottom wall 6252 and a contiguous upper portion formed in the base sidewall 6186 that extends upwardly from a laterally outer edge of the lower portion.

The insert 6104 optionally includes a plurality of insert vents 6260. In the example illustrated, insert vents 6260 are laterally spaced apart about the perimeter of the insert 6104. Each insert vent 6260, in the example illustrated, has a lower portion formed in the lower flange 6144 and a contiguous upper portion formed in the insert upper sidewall 6174 that extends upwardly from a laterally outer edge of the lower portion.

When the insert 6104 is assembled to the base 6102 and the lid 6208 is closed, the base and insert vents 6258, 6260 allow air to pass into and out of the interior of the container 6100. Some food items (e.g., fruits) naturally emit ethylene gas when stored. Ethylene accelerates the ripening of fruit. The base and insert vents 6258, 6260 allow the emitted gas to escape so that the stored food items do not spoil too quickly.

In the example illustrated, when the insert 6104 is assembled to the base 6102, each of the insert vents 6260 aligns with a corresponding one of the base vents 6258. Such a configuration can provide a direct pathway for air to flow into and out of the interior of the container 6100. In an alternative example, the insert vents 6260 and the base vents 6258 do not align when the insert 6104 is assembled to the base 6102. The lid 6208 optionally includes a plurality of lid vents 6262. In the example illustrated, the lid vents 6262 are laterally spaced apart about the perimeter of the lid 6108. The lid vents 6262 further increase the volume of air that can be circulated through the interior of the container 6100.

After use, the lid 6208 can be opened and the insert 6104 can be disassembled from the base 6102 by pivoting the insert 6104 relative to the base 6102 about the first living hinge 6206 with sufficient force to disengage the releasable engagement surfaces 6126, 6130. The insert 6104, the base 6102 and, optionally, the lid 6208 can then be rinsed and delivered to a recycling process.

The container 6100 includes optional stacking features that facilitate stacking the containers 6100 when in a closed configuration (FIG. 24). In the example illustrated, the lid 6208 includes four stacking members 6264. Each of the stacking members 6264 projects upwardly from the upper surface of the lid 6208 proximate a respective corner of the lid 6208. In the example illustrated, the stacking members 6264 are configured to fit within a portion of the peripheral bead 6108 of a container below. When the multiple containers 6100 are stacked, the stacking members 6264 on the lid 6108 of a container 6100 engage the peripheral bead 6108 of the container 6100 immediately above. Such engagement may impede the stacked containers 6100 from sliding laterally relative to each other and thereby enhances stability of the containers in the stack. This may be particularly beneficial in cases where the containers 6100 are stacked on a sloped surface of merchandise display.

What has been described above is intended to be illustrative of examples of the teaching disclosed herein, without limiting the scope of patent claims granted herefrom. The scope of such claims should be given the broadest interpretation consistent with the description as a whole.

The invention claimed is:

1. A container for food items, comprising:

a) a base formed of plastic and including a reservoir bottom panel and a peripheral bead, the peripheral bead having a bead inner sidewall extending about and upward from a perimeter of the reservoir bottom panel, a bead top wall extending laterally outward from an upper end of the bead inner sidewall, and a bead outer sidewall extending downward from a laterally outer edge of the bead top wall, at least a lower portion of the bead inner sidewall and the reservoir bottom panel enclosing, laterally and from below, a liquid collection reservoir, the base further including a base lower peripheral engagement surface extending about the liquid collection reservoir, wherein the base lower peripheral engagement surface comprises at least a portion of the bead top wall; and b) an insert formed of plastic and including a support panel, an insert lower sidewall extending upward from a periphery of the support panel, and an insert lower flange extending laterally outward from an upper end of the insert lower sidewall, the insert having an insert lower peripheral engagement surface comprising at least a portion of the insert lower flange, wherein the insert lower peripheral engagement surface is releasably interlockable with the base lower peripheral engagement surface to assemble the insert to the base with the insert lower flange bearing against the bead top wall and the support panel overlying the liquid collection reservoir, the support panel having a plurality of drain apertures for draining liquid from above into the liquid collection reservoir.

2. The container of claim 1, wherein at least one of the insert lower peripheral engagement surface and the base lower peripheral engagement surface is resiliently deformable to provide snap-fit, interlocking sealed engagement therebetween when the insert is assembled to the base.

3. The container of claim 1, wherein the base includes a plurality of spaced apart panel braces, each of the panel braces projecting upwardly from the reservoir bottom panel and abutting an underside surface of the support panel when the insert is assembled to the base to maintain a vertical separation between the support panel and the reservoir bottom panel when in use.

4. The container of claim 1, wherein the base includes a base sidewall having a base sidewall first end joined to a lower end of the bead outer sidewall, and a base sidewall second end spaced vertically above the base sidewall first end.

5. The container of claim 4, wherein the base sidewall first end is joined to the lower end of the bead outer sidewall via a base bottom wall extending laterally between the peripheral bead and the and base sidewall.

6. The container of claim 4, wherein the base sidewall includes a sidewall lower portion disposed at an equal elevation with, and spaced laterally outward from, the lower portion of the bead inner sidewall.

7. The container of claim 4, wherein the base sidewall second end includes a base rim, wherein the base rim is rounded to facilitate tear-free engagement with a film wrapped over the container to preserve freshness of the food items.

8. The container of claim 4, wherein the insert includes an insert upper sidewall having an insert upper sidewall first end joined to an outer edge of the insert lower flange and an insert upper sidewall second end spaced above the insert upper sidewall first end.

9. The container of claim 8, wherein the base sidewall includes a sidewall upper portion disposed at an elevation greater than the bead top wall and having a sidewall inner surface, and wherein the insert upper sidewall has a sidewall outer surface that bears in flush engagement with the sidewall inner surface of the base when the insert is assembled to the base.

10. A container for food items, comprising:

a) a base formed of plastic and including a reservoir bottom panel, and a reservoir sidewall, the reservoir sidewall extending about and upward from a perimeter of the reservoir bottom panel, the reservoir sidewall including a lower portion and an upper portion disposed laterally outward of the lower portion and connected to the lower portion by a generally horizontal step surface, at least the lower portion of the reservoir sidewall and the reservoir bottom panel enclosing, laterally and from below, a liquid collection reservoir, the base further including a base lower peripheral engagement surface extending about the liquid collection reservoir, wherein the base lower peripheral engagement surface comprises at least a portion of the reservoir sidewall;

b) an insert formed of plastic and including a support panel, an insert lower sidewall extending upward from a periphery of the support panel, and an insert lower flange extending laterally outward from an upper end of the insert lower sidewall, the insert further including an insert lower peripheral engagement surface comprising at least a portion of the insert lower sidewall, wherein the insert lower peripheral engagement surface is releasably interlockable with the base lower peripheral engagement surface to assemble the insert to the base with the support panel overlying the liquid collection reservoir, the support panel having a plurality of drain apertures for draining liquid from above into the liquid collection reservoir;

wherein, when the insert is assembled to the base, an outer surface of the insert lower sidewall bears against an inner surface of the reservoir upper sidewall and an underside surface of the periphery of the support panel beneath the insert lower sidewall bears against the step surface of the reservoir sidewall.

11. The container of claim 10, wherein the base further comprises a bead top wall extending laterally outward from an upper end of the reservoir sidewall, and a bead outer sidewall extending downward from a laterally outer edge of the bead top wall, wherein the reservoir sidewall, the bead top wall, and the bead outer sidewall form a peripheral bead extending about the liquid collection reservoir.

12. The container of claim 10, wherein at least one of the insert lower peripheral engagement surface and the base lower peripheral engagement surface is resiliently deformable to provide snap-fit, interlocking sealed engagement therebetween when the insert is assembled to the base.

13. The container of claim 10, wherein the base includes a plurality of spaced apart panel braces, each of the panel braces projecting upwardly from the reservoir bottom panel and abutting an underside surface of the support panel when the insert is assembled to the base to maintain a vertical separation between the support panel and the reservoir bottom panel when in use.

14. The container of claim 11, wherein the base includes a base sidewall having a base sidewall first end joined to a lower end of the bead outer sidewall, and a base sidewall second end spaced vertically above the base sidewall first end.

15. The container of claim 14, wherein the base sidewall first end is joined to the lower end of the bead outer sidewall via a base bottom wall extending laterally between the peripheral bead and the and base sidewall.

16. The container of claim 14, wherein the base sidewall includes a sidewall lower portion disposed at an equal elevation with, and spaced laterally outward from, the lower portion of the reservoir inner sidewall.

17. The container of claim 14, wherein the base sidewall second end includes a base rim, wherein the base rim is rounded to facilitate tear-free engagement with a film wrapped over the container to preserve freshness of the food items.

18. The container of claim 14, wherein the insert includes an insert upper sidewall having an insert upper sidewall first end joined to an outer edge of the insert lower flange and an insert upper sidewall second end spaced above the insert upper sidewall first end.

19. The container of claim 18, wherein the base sidewall includes a sidewall upper portion disposed at an elevation greater than the bead top wall and having a sidewall inner surface, and wherein the insert upper sidewall has a sidewall outer surface that bears in flush engagement with the sidewall inner surface of the base when the insert is assembled to the base.

* * * * *